US011085401B2

(12) United States Patent
Boswell

(10) Patent No.: US 11,085,401 B2
(45) Date of Patent: Aug. 10, 2021

(54) FUEL AIR DELIVERY CIRCUIT WITH ENHANCED RESPONSE, FUEL VAPORIZATION AND RECHARGE

(71) Applicant: George A. Boswell, Eagle River, WI (US)

(72) Inventor: George A. Boswell, Eagle River, WI (US)

( * ) Notice: Subject to any disclaimer, the term of this patent is extended or adjusted under 35 U.S.C. 154(b) by 0 days.

(21) Appl. No.: 16/538,545

(22) Filed: Aug. 12, 2019

(65) Prior Publication Data

US 2019/0368443 A1 Dec. 5, 2019

Related U.S. Application Data

(62) Division of application No. 14/914,954, filed as application No. PCT/US2014/053308 on Aug. 28, 2014, now Pat. No. 10,378,484.

(60) Provisional application No. 61/871,191, filed on Aug. 28, 2013.

(51) Int. Cl.

| | |
|---|---|
| ***F02M 3/00*** | (2006.01) |
| ***F02M 19/04*** | (2006.01) |
| ***F02M 3/06*** | (2006.01) |
| ***F02M 35/10*** | (2006.01) |
| ***F02M 69/08*** | (2006.01) |
| ***B01F 3/04*** | (2006.01) |
| ***B01F 15/02*** | (2006.01) |

(52) U.S. Cl.

CPC ..... *F02M 19/04* (2013.01); *B01F 3/04* (2013.01); *B01F 15/0203* (2013.01); *B01F 15/026* (2013.01); *B01F 15/0216* (2013.01); *F02M 3/06* (2013.01); *F02M 35/10216* (2013.01); *F02M 69/08* (2013.01)

(58) Field of Classification Search

CPC .... F02M 19/04; F02M 3/06; F02M 35/10216; F02M 69/08; B01F 3/04; B01F 15/0203; B01F 15/026; B01F 15/0216

USPC ..... 261/41.5

See application file for complete search history.

(56) References Cited

U.S. PATENT DOCUMENTS

| | | | |
|---|---|---|---|
| 2,892,622 | A | 6/1959 | Goodyear |
| 2,957,683 | A | 10/1960 | Eberhardt |
| 4,913,855 | A | 4/1990 | Panzica |
| 6,439,546 | B1 | 8/2002 | Galka |
| 6,871,843 | B2 | 3/2005 | Abel et al. |

FOREIGN PATENT DOCUMENTS

| | | |
|---|---|---|
| GB | 26096 | 11/1910 |

*Primary Examiner* — Robert A Hopkins

(74) *Attorney, Agent, or Firm* — Matthews Edwards LLC

(57) ABSTRACT

A fuel air delivery circuit, system, and method for the intake of an internal combustion engine, that provides an enhanced pressure condition to a supplementary or auxiliary air fuel circuit or circuits in connection with a conventional fuel delivery passage or passages, such as, but not limited to, a main, needle, or other jet, injector port, manifold, plenum, or the like, to provide enhanced vaporization and mixture of the fuel and air, and delivery to an associated intake path, such as the bore of a carburetor, intake runner, or the like, to provide improved throttle response and acceleration, and additionally which supplementary circuit will automatically recharge with fuel when a triggering condition is present, such as under steady state and deceleration conditions.

19 Claims, 25 Drawing Sheets

SEE NEEDLE AND SEAT TO THE LEFT; THE CENTER IS THE NEEDLE JET; THE RIGHT IS THE PILOT JET

NEEDLE AND SEAT LEFT; NOTE MAIN JET AT BOTTOM OF NEEDLE JET TUBE; PILOT JET AND CHOKE FUEL TUBE

DIFFERENT VIEW OF NEEDLE AND SEAT AND NEEDLE JET TUBE/MAIN JET

CUTAWAY SHOWING CAVITIES FOR THE RELATED COMPONENTS

FRONT VIEW WITH SLIDE INSTALLED

FRONT VIEW WITH SLIDE INSTALLED

VIEW SHOWING THE FACE PLATE INSTALLED;
NOTE THE CUTAWAY NEAR THE AIR CORRECTION JET

SHOWING THE BACK SIDE OF THE NEW ENTRIES AT THE TOP AND BOTTOM

NOTE THE SODERED POINT AT THE RIGHT OF WHICH SEALS THE OEM NEEDLE JET

FUEL AIR DELIVERY CIRCUIT WITH ENHANCED RESPONSE, FUEL VAPORIZATION AND RECHARGE

This application is a divisional of co-pending patent application Ser. No. 14/914,954, filed Feb. 26, 2016, which application is submitted under 35 U.S.C. 371 claiming priority to PCT patent application Serial No. PCT/US2014/53308, filed Aug. 28, 2014, and which application claims the benefit of U.S. Provisional Application No. 61/871,191, filed Aug. 28, 2013.

TECHNICAL FIELD

This invention relates to a fuel air delivery circuit, system, and method for the intake of an internal combustion engine, and more particularly, that provides an enhanced pressure condition to a supplementary or auxiliary air fuel circuit or circuits in connection with a conventional fuel delivery passage or passages, such as, but not limited to, a main, needle, or other jet, injector port, manifold, plenum, or the like, to provide enhanced vaporization and mixture of the fuel and air, and delivery to an associated intake path, such as the bore of a carburetor, intake runner, or the like, to provide improved throttle response and acceleration, and additionally which supplementary circuit will automatically recharge with fuel when a triggering condition is present, such as under steady state and deceleration conditions.

BACKGROUND ART

Co-pending patent application Ser. No. 14/914,954, filed Feb. 26, 2016, PCT patent application Serial No. PCT/US2014/53308, filed Aug. 28, 2014, and U.S. Provisional Application No. 61/871,191, filed Aug. 28, 2013, are hereby incorporated herein in their entirety by reference.

In FIGS. 4 and 7; the notations BNG-15/22/23/24/29 represent several views of a prior art needle jet configuration. In particular, the notation BNG-22: (side-view); BNG-23: (rear-view); BNG-24: (front-view) and in FIG. 7, BNG-29 represents needle jet prior art (side-view). Further in FIG. 4, number BNG-17 (see Detail A, FIG. 5) shows the detail of the passages that surround a stock or conventional needle jet outlet. In viewing FIG. 5; it should be noted that the details of the BNG-17 area show the relationship with the needle jet main body BNG-15. In contrast, referring briefly to the present invention as explained below, the notation STIC-BNG-11 identifies a passage that communicates with the BNG-17 structure by passing into the peripheral passage/s BNG-18 and BNG-19. In this regard, it should be noted that BNG-11/05 of the prior art does not flow into the BNG-06 passage exit area nor does it communicate with the BNG-06 interior passage in any manner; unless it is the bleeder type; see number BNG-30 "bleeder types" wherein BNG-05/11 does not enter into the extreme BNG-06 exit.

Category A and B; Various Stages of the Prior Art Needle Jet

Prior art in the described needle jet falls into two basic categories. See FIG. 6: (A) BNG-29 and FIG. 7 (B) BNG-30 aspect utilized in the new design of the invention. (A): The standard needle jet BNG-29 is utilized in most applications. (B): Number BNG-30, the least popular is referred to as a "bleeder type" meaning that it has emulsion bleeder holes that are evident in FIG. 7.

In studies of prior art including sophisticated carburetor types; e.g., those made by Weber, Dellorto; Mikuni, Keihin, Holley, Rochester, Carter, Tecumseh, Briggs and Stratton, Solex, etc., none of these prior art carburetors disclose the combination of the present invention of vectored entries wherein the enhanced pressure comes in at a high rate of speed from the exterior BNG-09 area that receives its pressure from other controlled sources. Of the other systems that receive frontal air via an air bleed orifice and/or a changeable jet of various dimensions; often referred to as a high speed jet (or air-bleed); there is no attempt to cause shearing vectored vaporization. This is particularly true in the field of recreational carburetors; wherein simple bleeder (bubbler) type emulsification is the only target goal elected by the manufactures.

Weber, Dellorto; and Mikuni (Weber Type) Prior Art Needle Jets

See drawing FIG. 2; which illustrates the needle jets utilized by Weber, Dellorto, and the Mikuni (similar to the Weber, Dellorto) in their more sophisticated carburetors for automotive/light truck applications; wherein they bring the fuel in from the main jet area wherein the fuel enters the central part of the main jet wherein it is directed to the outside peripheral area surrounding the needle jet structure. The outside atmospheric air (and not enhanced as in the present invention) then enters the top of the needle jet area via air correction air jet (common to the industry) wherein this air is brought into a center air bleeder emulsion cavity (or tube); then as the peripheral fuel passes the air emulsion passages (may be angled and/or straight); to allow the atmospheric air to bubble into the fuel wherein it then passes into fuel passage(s) leading ultimately to the booster(s) or other outlet(s).

This method of emulsification (atmospheric air bubbled into the fuel) is common to the industry (and is commonly referred to as a bubbler method); it is also utilized in idle, intermediate, and auxiliary circuits wherein simple air bubbler emulsification is desired. Within the aforementioned Weber, Dellorto, and the Mikuni type that is made similar to the Weber/Dellorto concepts; there is no attempt to vaporize the fuel and/or to accelerate the overall mixture speed in the needle jet; those systems simply allow atmospheric air to bleed (bubble) into the passing peripheral fuel causing a non-aggressive air to mix (emulsify) into the targeted fuel stream.

Overview of Prior Art

For example, there are numerous carburetors wherein the booster is an inserted item; this in particular is utilized on Holley carburetors as well as Webers and others. However there is no evidence to support that there is a booster that is part of the needle jet structure as a stand-alone component. For purposes here, the term "needle jet" refers to a removable tuning component that is inserted into a cavity wherein it is retained mechanically such as being threaded into a receiver and/or it is retained by another mechanical means in much the same fashion as a metering jet. As examples, the primary metering orifice (the main jet in this instance) is often threaded or pushed into the incoming fuel end of the needle jet. In the recreational and Weber, Dellorto, Mikuni carburetor field; the needle jet is a stand-alone tuning component that is inserted into the aforementioned carburetor as a tuning component wherein the main jet is inserted into it by various mechanical means.

Another example of an inserted/cast-in booster is the Carter and Rochester carburetors wherein their boosters are sometimes removable; and some units may have air bleeds and emulsification bubbler holes within their booster structure; see for example J. E. Eberhardt, U.S. Pat. No. 2,957,683 (FIGS. 7, 8, 9, 10). Also see J. E. Eberhardt, U.S. Pat.

No. 2,957,683 (FIG. 6); wherein it shows the primary and secondary boosters as an insert.

One observation with regard to the known prior art as generally referred to above, is that the fuel circuits lack, nor contemplate, the use of vectored vaporizing circuits pressurized in an enhanced manner, that is subjected to extreme pressure differential. In contrast, the present invention utilizes vectored passages or entries that can be vectored in a variety or unlimited number of ways, including, but not limited to, a positive angle (with or in the general direction of the fuel flow); and/or in a perpendicular and/or at a negative angle to the flow.

Another observation is that from the most sophisticated Weber carburetors to the simplest system generally referred to above; none pressurize the emulsification mixtures in an attempt to vaporize them (consisting of air, fuel; air/fuel; and or other combinations) into the associated or targeted fuel or air/fuel circuits. Contrary to the present invention principles as explained in detail below, the known prior art systems can be summarized as utilizing only emulsion air passages that cause the air to merely bubble into the associated fuel flow.

As still another observation, the prior art systems referred to above all allow the main fuel flowing past the air source (the air emulsification holes) by a differential bubbling action to cause emulsification via the air bleed passage(s). It is also observed that their air emulsion bleed passages are shallow. This is disadvantageous as it has been found to thus inhibit directional mass flow characteristics utilized according to the present invention and beneficial to create a pressure drop as the air/fuel combination enters the main targeted fuel flow with a directional force that has not been dispersed or diminished significantly.

Overview of Illustrated Prior Art and the Present Invention in Needle Jet/Booster Context Prior art: see FIG. 4; numbers BNG-22 (side-view), -23 (rear-view) and -24 (front-view); represents a majority of the known prior art needle jets that are available in the industry; they have been in existence for over 50 years with only a few changes over the years.

Prior art: see BNG-17 in detail (A); note that frontal air coming into passage BNG 11; passage BNG-22 enters into BNG-05 which enters into a peripheral area BNG-19 that surrounds passage BNG-06; thus the BNG-11 air source does not enter into the top of the BNG-06 fuel passage exit via the BNG-19 peripheral area.

Prior art: see FIG. 6; number BNG-30 "bleeder types"; the frontal air from passage BNG-11 enters into the cavity surrounding the outer circumference of the middle of the needle jet BNG-09; wherein this air enters the prior art emulsification bubbler openings. In this instance of the BNG-30 bleeder type; the BNG-11 air source does not enter into the BNG-19 peripheral area as there is none.

To summarize observed operational shortcomings, the known prior art fuel delivery circuits referred to and described above have been found to provide less than optimal vaporization and mixture of the fuel and air, with less than desired throttle response and acceleration. The known systems also lack nor do they contemplate an ability to quickly recharge under lower fuel demand conditions so as to be able to provide rapid response and acceleration when demand is subsequently present.

SUMMARY OF THE INVENTION

What is disclosed and claimed is a supplementary fuel air delivery circuit, system, and method for the intake of an internal combustion engine, in connection with a conventional fuel delivery passage, such as, but not limited to, a main, needle, or other jet, injector port, manifold, plenum, or the like. This supplementary circuit is connected with a source of positive pressurization that enhances the pressure condition therein, such that, when a negative pressure signal is communicated to the associated main, needle or other jet or passage as a result of opening the throttle, or other demand signal, the supplementary circuit will virtually immediately respond by supplying air and highly vaporized fuel into the associated jet or passage, resulting in improved response and greater acceleration than achieved by associated jet or passage alone. When the demand is diminished, for example, under deceleration conditions such as reduction of throttle or other demand signal, the supplementary circuit will automatically recharge or replenish with fuel, e.g., from one or more sources, which can include, but are not limited to, reverse flow from the associated jet or passage, connection with another fuel source, such as a fuel bowl or other fuel holding chamber or cavity, e.g., of a carburetor.

The supplementary circuits of the invention can be incorporated into existing carburetors, intake manifolds, intake runners, and in association with fuel injectors, and the like, and also new designs as desired or required for a particular application.

Various stages of the supplementary circuits claimed according to the invention are illustrated incorporated into an improved needle jet, in FIGS. 1, 3, 4, and 7-12A, which show using arrows the air, fuel, air/fuel, vapor, pressure and combinations therein; entering the designed mixing device(s) wherein it is conducted into the new/modified booster/needle jet apparatus at an acute included angle, e.g., relative to a lengthwise axis or center line of a body of the new/modified booster/needle jet in order to provide desired air flow to enhance total air/fuel, air, fuel vaporization. Air, air/fuel/vapor/pressure and combinations therein; that are flowing through the new and/or modified needle jet; (consisting of pressure/air, fuel, air/fuel/vapor and/or combinations of mixtures therein) traveling over and through the needle jet designated BNG-06, in the main flow direction. In addition to increasing the rate of evaporation at each new pressure crossing entry point; the process also increases the evaporative cooling effect; and ultimately increases the amount of air, fuel, air/fuel/vapor surface area that becomes suspended in the pre-combustion mixture charge in the form of a magnitude of condensed fine molecular/elemental droplets.

According to a further aspect of the invention, the vapor containing these fine droplets are mixed under violent conditions to cause a substantial amount of the fuel droplets to evaporate and become suspended in the air flow; resulting in the various elements having close proximity to each other; resulting in a further cooling effect and a higher entropy mixture to increase the mixture's enthalpy (the energy content of a system per unit mass). In the embodiments shown herein; the components shown have been observed to produce air/fuel mixing that is particularly violent, resulting in a more volatile air/fuel mixture.

DETAILED DESCRIPTION OF THE INVENTION

Figure 1:
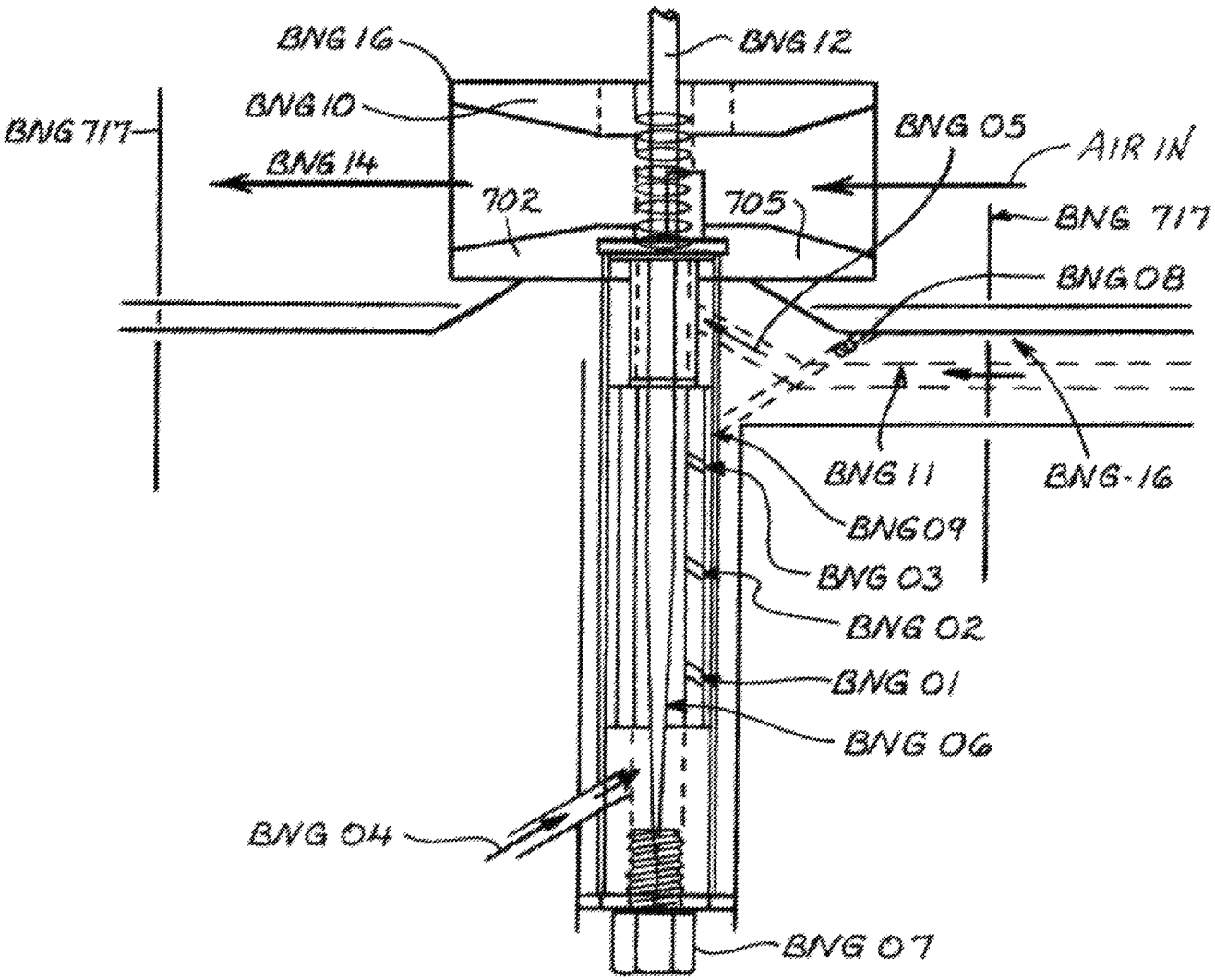
FIG. 1 is a simplified schematic diagram showing circuitry of the invention incorporated into carburetor needle jet circuitry.

Preferred embodiments of the invention are illustrated in FIGS. 1, 3, 4, and 7-12A, and related modifications. The basic modification to a prior art needle jet structure to incorporate the invention is simple and requires no modification to the original carburetor other than to the needle jet. The more refined modification of which could include an additional booster and/or a new needle jet structure will ultimately encompass a more sophisticated modification and may require a modification to the throttle opening device, e.g., round/flat slide and/or plate, when utilized on a carburetor and/or fuel injection system that utilizes a slide mechanism or throttle plate assembly to control the main air flow opening. A majority of the units that utilize a butterfly device, e.g., rotating shaft that the blade (plate) is affixed to, will require little or no modification to install the modified needle jet of the invention. The invention can also be incorporated into a needle jet in stages and/or combinations of features.

The STINJ and the STBNG Needle Jet

The first modification to existing prior art needle jet and/or the new structure needle jets according to the invention described in this document include the STNJ, STBNG brass needle jet/s combinations; Stage 1 thru infinity; with various options and features. Although the prior art needle jet is constructed with a brass alloy; it is conceivable that the new needle jet may be made of brass or other materials if desired.

Throughout all of the drawings; FIGS. 1, 3, 4, and 7-12A, number(s) BNG-11 and BNG-14 represent the direction of the main air flow passing over/through the needle jet devices into the engine. Number BNG-07 represents air/fuel and/or fuel source/s into the objects of discussion (the main/auxiliary/idle/intermediate/jet/s, orifices, etc.).

The auxiliary air pressure flows (air/fuel/, air, fuel, pressure, vapor, etc., and combinations therein; are derived from the main flows as well as outside flows (example: turbo/super chargers) and will be highly pressurized compared to convention flows, so as to increase velocity and responsiveness noticeably. The first descriptions will address: (A) the "New" STINJ (Stic-Torque-Induction Needle-Jet); and (B); the "New" STBNG (Stic Torque-Booster) Needle Jet, J-(G).

The STIC System

When utilizing a frontal air and/or an optional pressurizing system; wherein vectored passage or entries to the needle passage are targeted to enter the needle passage at a preferred elongated vectored angle in the same direction (flow) as the targeted flow (fuel flow through the needle passage to the air flow passage); this is the preferred embodiments of the present invention for the following reasons.

Conventional 90 degree circuit entries are believed to have a more effective stronger shearing surface area pressure drop imposed on them due to fundamental physics; however, the downside is this; as the outside air circuit enters at 90 degrees (perpendicular to the target flow) it is believed to have a tendency to limit the vaporizing qualities due to the air, air/fuel, etc., entering having a tendency to disperse in both directions (in a +/− longitudinal direction).

A STIC-BNG vectored pressurized entry has been found to have several benefits. A vectored directional pressurized force entry when combined with the targeted directional flow force will more positively increase the total flow vectored velocity and volume; this design concept has been found through testing to result in greater vaporizing qualities.

This concept has not been found in the prior art. These new vectored pressurized circuit concepts utilizing angularly oriented vector passages through the body of the needle jet at multiple locations longitudinally therealong, causes a velocity multiplying effect as the pressurized vectored circuits combine with each other to cause progressive vaporization and acceleration of the targeted mixture within the needle passage which is in communication with the air flow passage of the carburetor or other air fuel mixing device, or intake tract with which the invention is used. The BNG-06 needle jet interior air/fuel outlet is directed to exit into the main flow air stream BNG-14.

Ultimately the BNG-06 passage could exit into its standard hooded/non-hooded air stream opening and/or into a STIC-BNG-10 booster outlet as will now be explained.

The BNG-10 Needle Jet Booster

Figure 3:
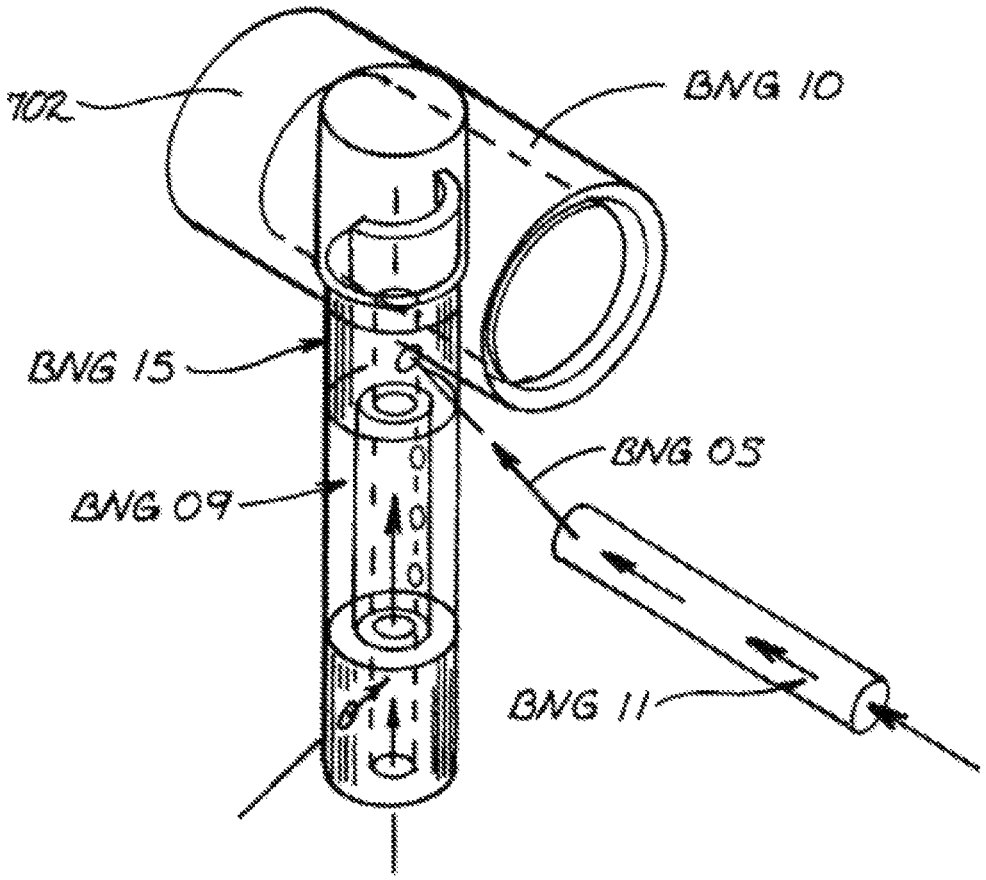
FIG. 3 is a simplified schematic perspective view showing a carburetor needle jet modified to incorporate aspects of the invention, including a booster.
Figure 4:
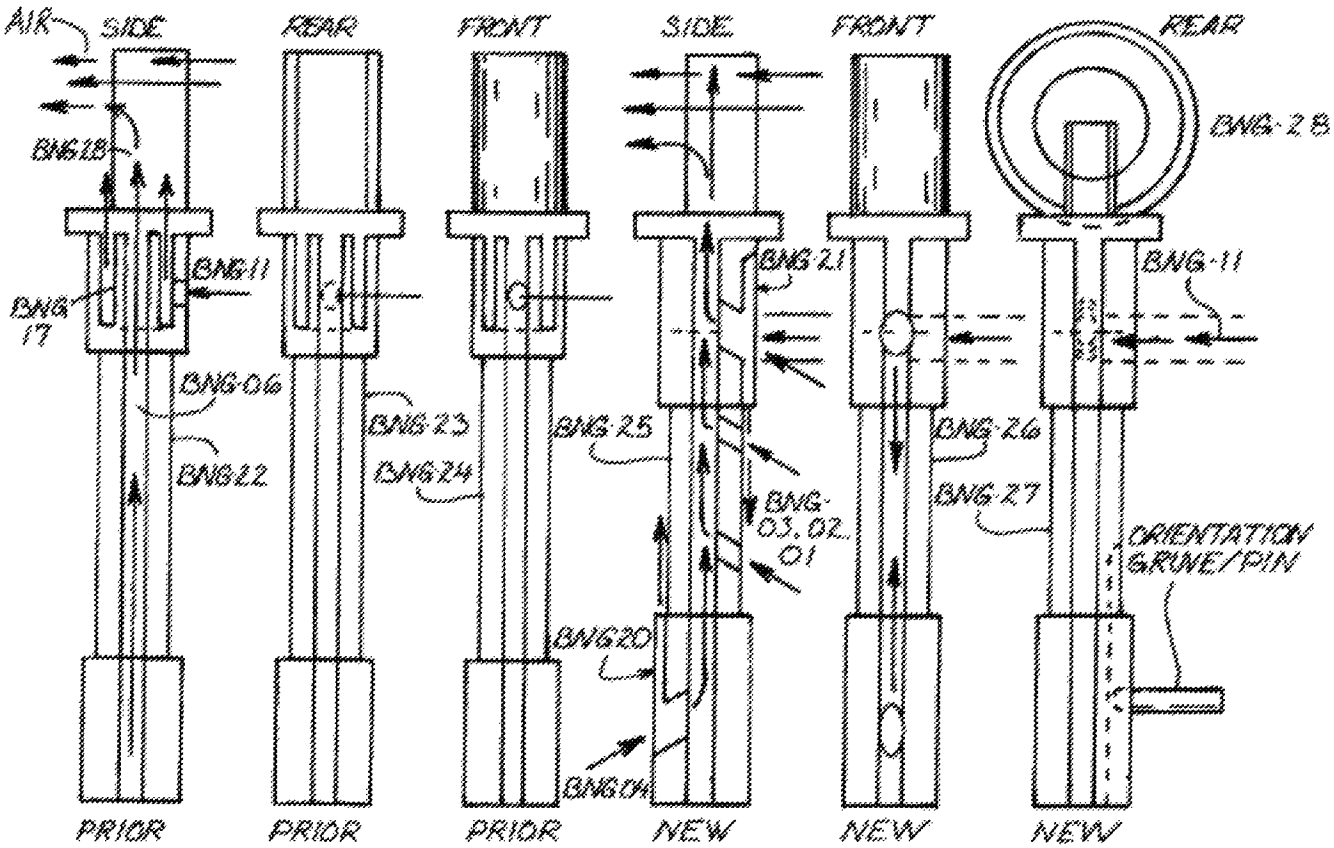
FIG. 4 is a series of simplified schematic side views of a needle jet, showing a progression of modifications to incorporate aspects of the invention.

See FIGS. 1, 3, 4. As directional frontal air begins to flow across/through the BNG needle jet outlet opening and/or the new STIC-BNG-10 booster outlet towards the engine; the hooded area and/or BNG-Booster output area will cause a scavenging effect (suction) on its supplementary feed circuit(s) that are emanating from the BNG-06 flow and its connected circuits. As the BNG-11, BNG-14 airspeed increases; the hooded outlet and/or the new STIC-BNG-10 booster's greater suction (scavenging) is transmitted to the pressurized outside auxiliary feeding entries via the BNG-06 passage and/or other designated passages. These combined forces multiply and increase the overall velocity as the forces continuously combine, to vaporize and multiply progressively. As the flow of the BNG vectored pressurized outside source(s) (vector passages) enter and cross the main targeted flow; in this case the BNG-06 flow in the needle passage; this creates a pressure drop on the targeted incoming flow (in this case the BNG-06 flow) at the base of each crossing circuit as it enters and crosses the targeted BNG-06 flow.

This positive action is believed to result in a substantial increase in the fuel vaporization; density reduction of the mixture, and increase the overall acceleration of the mixture. As the main fuel and/or air/fuel flow (the front spearhead of the BNG-06 flow; the top of the air/fuel column) is approaching each vectored crossing circuit(s); the crossing circuit(s) due to its/their created shearing pressure drop; this will cause a higher differential pressures at the spearhead of (the front) the BNG-06 main flow column and at each crossing; thus causing a very high overall escalating vaporizing pressure drop on the fuel and/or air/fuel flow "head" at the front of each cross flow.

This configuration is believed to improve the overall differential pressure at each crossing entry; thus multiplying (escalating) the vaporizing quantity and the quality. The total multiplying, escalating and vaporizing effect of the BNG vector passages combined now impose escalating pressure drops at each point of entry; this process allows the mixture to accelerate due to the fact that the targeted mixture has become lighter (less dense) at each point and then progressively lighter due to the fact that it is being continuously vaporized in a sequential multiplying series of steps. This higher vaporizing process creates an increase in the mixture flow rate (velocity and scavenging) that will be imposed on the outside supplementary emulsification source pressurizing input; again imposing vaporizing qualities that escalate and multiply in an ever-increasing scavenging suction manner.

In other words, the forces of the incoming vectored flows combine together to increase the overall speed of the air and fuel mixture through the needle passage; and this creates a scavenging force (suction) upstream that is communicated with the incoming outside auxiliary forces downstream (before their entry into the targeted circuit); thus a multiplying escalating energy is created due to progressive density reduction by enhanced sequential pressurized vaporization.

Number BNG-12 represents an optional needle that may or may not be utilized in a needle jet (and/or a BNG-10 booster) to provide final orifice restrictions to the fuel; air/fuel/vapor outlets. Note that number BNG-13 is not utilized throughout the drawings. Numbers BNG-11; 14 represents the direct outside air flows that pass through and/or around the mixing device(s) and its components as they exit into the engine structure.

Modified STIC-BNG Needle-Jet

Figure 7:
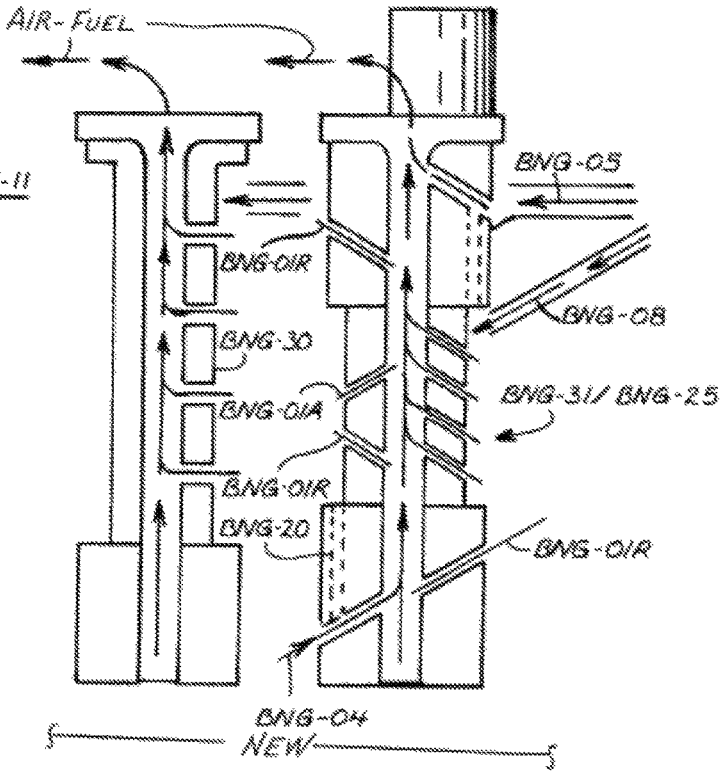
FIG. 7 is a simplified schematic side view of two needle jets, constructed and showing flow according to the invention represented by arrows.

The modified STIC-BNG needle jet is represented in FIGS. 4 and 7, numbers BNG-25 (side-view), -26 (front-view) and BNG-27/31 (rear-view with a STIC booster). Details of the area that surround the BNG-17 area of the modified unit are presented in the FIG. 12A. Note that the modified BNG-17 area allows direct frontal air to communicate with the interior of BNG-06 circuit via air passages.

BNG-11 and/or BNG-04/05 via BNG-20/21 does not allow entry into the prior art BNG-17 peripheral area BNG-19; as in the new modification; although it could, it is preferred to not have communication with the BNG-19 peripheral area in lieu of the more efficient configuration of the invention.

FIG. 7; number BNG-31/25 represents a STIC-BNG modified needle jet with the standard outlet hooded area; this represents a modified unit without the STIC booster BNG-10 (aka 702/703). See the reference to details that are revealed in FIG. 8.

Drawing numbers BNG-31/25 show modified multi-directional pressurizing passages BNG-20 and BNG-21; this allows sources BNG-11 through BNG-04 and BNG-05 to independently, and/or in conjunction, provide pressure sources (including mixtures) directly into the main needle passage or interior BNG-06 via BNG-01, 01A, 02, 03, 04, 05, 20/21, etc. This concept allows the BNG-04 and BNG-05 areas to receive pressure from the BNG-20/21/BNG-11 frontal air as a stand-alone modification and/or to receive pressure from various stages of other designed systems.

Figure 8:
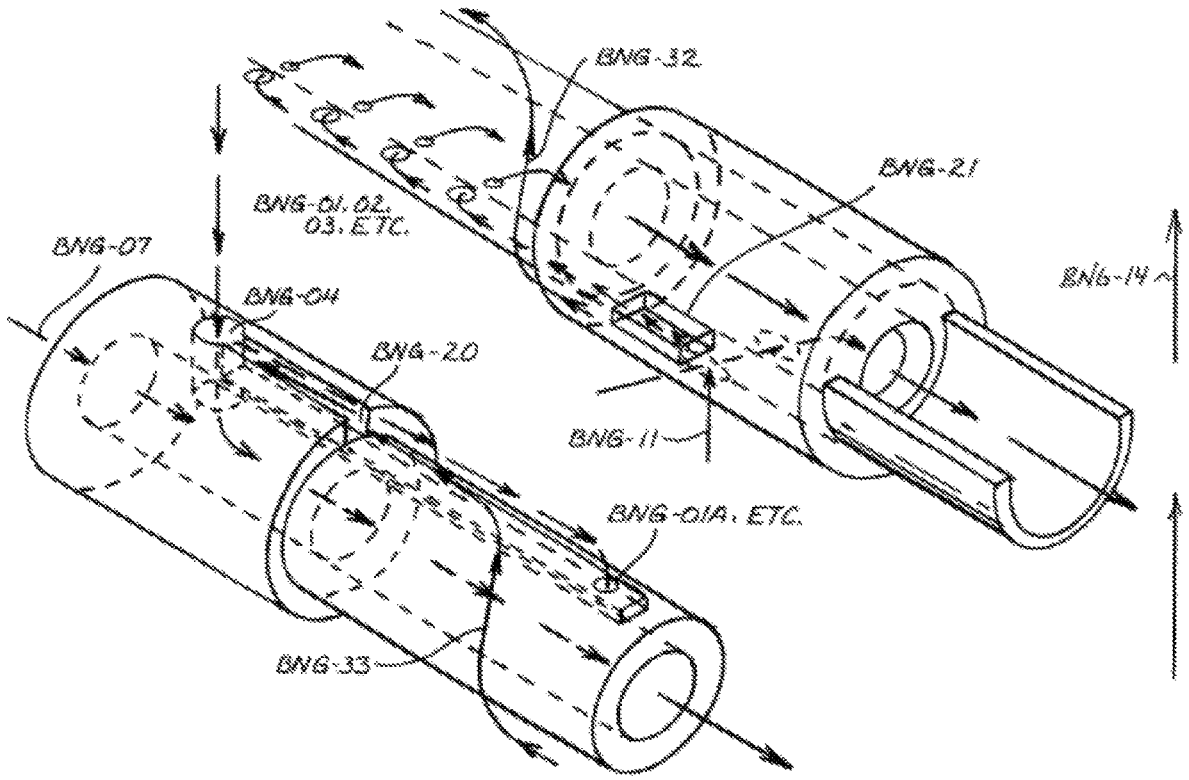
FIG. 8 is a fragmentary perspective simplified schematic side view of a needle jet according to the invention, showing flow represented by arrows.
Figure 9:
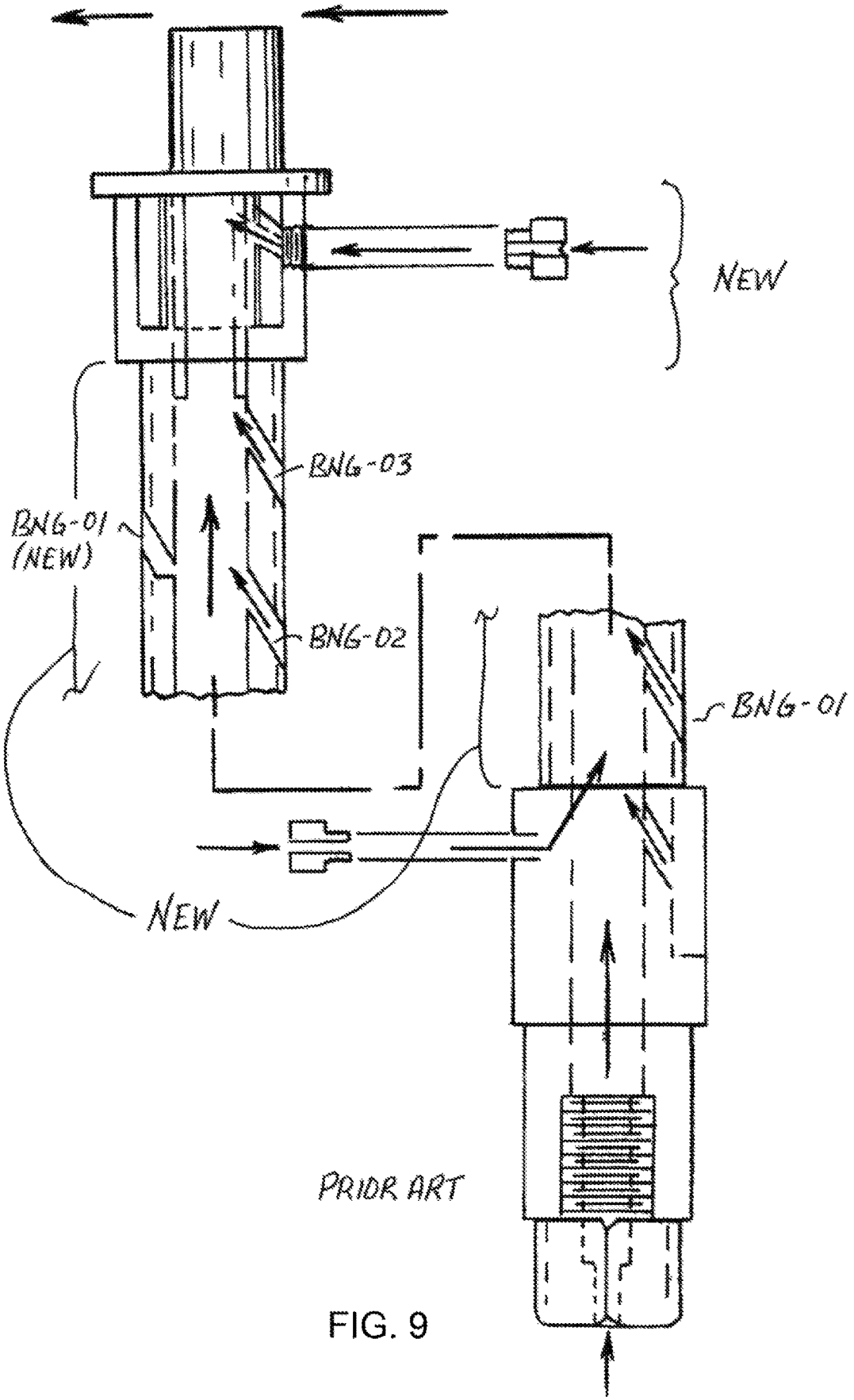
FIG. 9 is a fragmentary simplified schematic side view of a needle jet, showing prior art aspects and aspects according to the invention, with flow represented by arrows.

FIG. 8 provides isometric half view/s of a STIC-BNG modified needle jet; showing rear-view of the upper end (BNG-32) as well as the rear-view of the lower end (BNG-33). BNG-09 represents the air cavity that surrounds the needle jet assembly BNG-15 when it is inserted within its holding structure within its BNG-16 assembly. BNG-12 represents the needle that is inserted as a metering restriction when (this could be stationary as well as being able to slide up and down) installed within the BNG-15 needle jet housing. There are some applications that do not have a needle. In order to allow auxiliary (additional) air, fuel, and/or air/fuel/vapor; pressures; and combinations (other than through the BNG-07 orifice/jet) thereof to enter into the BNG-06 area that surrounds the BNG-12 needle; it may enter through passages (circuits) that communicate with other air, fuel, air/fuel, and/or other pressure, vapor sources and/or combinations therein. This is accomplished by having other sources that are designed to communicate with the interior needle passage BNG-06; wherein orifice(s) consisting of one or more, that are designed to communicate with their sources that are designed to communicate with the BNG-06 area. In the illustrations provided; the following air, fuel, air/fuel, vapor/pressure, etc., combinations therein and other sources (that may include pressure source passages) are represented by vector passages of the invention having the following numbers; BNG-01; 01A, BNG-02; BNG-03; BNG-04; BNG-05; BNG-07; BNG-08 and BNG-11; BNG-20; -21; etc.

Depending on the required supplementary air, fuel, air/fuel, vapor, pressures, etc., and combinations therein; ultimately that decides the number of vector passages that are installed. BNG-07 represents the main/secondary fuel jet/orifice(s) coming from a fuel supply; the bowl; the diaphragm fuel cavity; and/or from an auxiliary fuel well/circuit; of which could include fuel injection (mechanical/electrical). There are one or more cavities or spaces of the invention that are present within the BNG-15 needle jet assembly; these at a minimum; consist of a cavity that surrounds the outside of the needle jet assembly BNG-15; that area is designated as BNG-09. Within the interior of the BNG-15 needle jet assembly; where the BNG-12 needle is inserted when applicable; there is another cavity, which is the needle passage BNG-06 that surrounds the BNG-12 needle. The BNG-06 represents the interior air/fuel/pressure passage area that surrounds the needle BNG-12. In these illustrations; the BNG-04/05 vector passage(s) is/are preferred to be angled (upward vectored) toward the outlet (exit) of BNG-06; entry from frontal air passage(s) BNG-11 and/or from other designed sources wherein this air, fuel and/or air/fuel/vapor and/or pressure(s) and/or combinations therein are directed via BNG-20/21, etc.,—into area BNG-09 that surrounds the BNG-15 center section and then into the BNG-06 area via vector passages BNG-01, 01A, 02, 03, 04/05, etc.

This BNG-09 cavity; communicates with its outside source(s) of air, fuel, and/or air/fuel, and/or other vapor/pressures (BNG-04/05/20/21, etc.); and those will pass through the vector passages BNG-01, etc., to enter the BNG-06 area at a preferred vectored angle via emulsification pressure passages of at least one/or more. This causes a pressure drop as the BNG-01, 02, and 03 or more sources pass across the BNG-06 fuel, air/fuel flow spearhead direction that is flowing upward toward the BNG-06 outlet and into the air-flow BNG-14 traveling to the engine. BNG-04/05/20/21, etc., represents one or more preferred vectored frontal air, and/or air/fuel vapor/pressure passages or source/s that are directed into the needle jet directly into the BNG-06 cavity via the BNG-09 area. The BNG-04/05/20/21, etc., passages could be in a single location or multiple locations; entering the targeted fuel flow that passes through the main jet BNG-07 into passage BNG-06.

The one/or more pressurized emulsification/vaporizing vector passages; BNG-01, 02, 03, etc., are designed to cause additional vaporization by pressure drops as they enter (at a preferred vectored angle) and cross air, air/fuel, fuel/vapor flowing from the main jet/orifice BNG-07 into the needle-jet interior passage BNG-06; flowing in the direction of their designed outlet into the air stream BNG-14.

The air, air/fuel/vapor/pressure sources passing through vector passages BNG-01, 02, 03, etc., enter from the BNG-11 passage via the BNG-04/05/08/20/21, etc., passage/s; then pass into the BNG-09 cavity via BNG-20/21, etc., that surrounds the needle jet BNG-15 outer passage (BNG-09). From that position, the pressurized emulsification air, air/fuel, vapor/pressure source then enters the BNG-06 interior area via the BNG-01, 01A, 02, 03, 04, 05, etc., vector passages.

Vapor/pressure and/or air or fuel emulsification and the pressure drops by the BNG concept are caused to intersect or cross the targeted circuit directional flows of air; air/fuel; and/or fuel/alcohol combinations therein. This concept causes a higher degree of total vaporization and emulsification. The crossing circuits; that cross or intersect the targeted flow; causes a pressure drop and density reduction at the surface of each crossed circuit point.

The crossing circuit(s) will cause the flow in the intersected circuit to increase its speed due to being vectored as well being vaporized at the crossing point; causing a pressure drop and density reduction above the intersected circuits spearhead flow as it approaches the other intersected circuit(s) and ultimately the BNG-06 outlet.

The BNG-20; BNG-21; BNG-11, BNG-08; BNG-05; BNG-04; BNG-03; BNG-02; BNG-01; BNG-01A, etc.; incoming elongated vector passages are being pressurized from an auxiliary source feed, vector passages BNG-04/05/11/20/21, directed into the targeted intersection; this causes increased emulsification as well as the customary vaporization associated with air that is being sheared into the fuel, air/fuel, vapor, emulsified mixture and an inherent pressure drop caused by the vectored directional entries as they cross the main targeted flow direction(s).

There are several distinct things that happen in an optimized design such as the STIC-BNG systems. (1): When the main fuel flow starts flowing via the BNG-07 (main jet and/or restrictions) in other related circuits in a STIC-BNG system within the designated fuel tube/orifices; the STIC-BNG system exerts a pressure drop as this flow intersects/crosses the main BNG-07/06 flow. Then as the STIC-BNG air, air/fuel/pressure/vapor, etc., enters the vectored circuits entering into the fuel well/circuit flow; this physical act of the air, air/fuel/pressure and/or combinations therein entering with a directional vectored force, causes an additional pressure drop and density reduction at each point where the BNG pressurized source intersects/crosses the main fuel flow spearhead. (2): This shearing vectored pressure drop will cause a higher degree of vaporization at each crossing point as well as causing the targeted flow to increase its speed due to the outside vectored force creating a shearing pressure drop, thus lowering the density of the BNG-06 mass and then being combined with the targeted vectored flow. Note that the total BNG concept allows progressive vaporization and density reduction at each intersecting/crossing point; this is accomplished by a "Shear pressure Drop" at each intersecting/crossing point.

The STIC-BNG jet tube/booster combination with the SVRBIS concept could be in a category by itself for recreational and car applications. Foreign market cars in the past, utilized Weber, Solex, and Dellortos; some of those carburetors utilized brass metering tubes prior to the booster outlet; however none of them utilized the pressurized vectored vaporizing concepts.

NEW STING/STBNG

NEW STING/STBNG: FIG. 4 numbers BNG-25 (side-view), -26 (front-view) and BNG-27 (rear-view) represents an overview of the NEW BNG (Brass) Needle Jet modifications in various positions. Numbers; BNG-01; 01A; -02, -03; etc., represent one or more preferred vector passages for air, pressurized vapor, emulsified fuel air, entries.

Note the NEW number BNG-25 wherein passage BNG-20 and -21 represent milled passages starting from BNG-04 and BNG-05; this allows the BNG-11 air source to feed the associated vector passages and emulsification pressure circuits from either source and/or simultaneously from the BNG-04 and BNG-05 preferred pressurized vectored high volume passages. This arrangement allows a progressive pressurization originating from the BNG-11, -05, -04 areas progressing into the BNG-01, -02, -03, vector passages etc. area via BNG-20/21 etc., and then progressing into the BNG-06 area (needle passage) flowing to the exit of the needle jet and into the main air flow BNG-14 in a highly pressurized/highly vaporized state. This pressurized air; air/fuel/pressure/vapor may enter at any timed selected location; causing extraordinary pressurization of the primary targeted booster/s and or targeted circuits.

It should be noted that the BNG concept progressively increases the vaporization and lowers the density of the fuel mixture at each intersection/crossing point; thus increasing the overall velocity of the targeted circuit due to an ever increasing density reduction of the targeted mixture.

It should be noted that one of the greatest obstacles in prior art metering systems, is overcoming the density (weight) of the fuel mixtures and inertia. Note that conventional prior art emulsification does not cause vaporization to any degree within the designated circuit.

Testing reveals that the STIC-BNG needle jet without the booster provides a substantial increase in performance over the prior art needle jet and could function as a stand-alone BNG "Phase One" modification that provides substantial improvements in vaporizing quality and performance. The BNG-25, -26, and -27 modified units in combination with the STIC-BNG-10 (aka 702/703, etc.) booster represent a significant increase over the STIC-BNG needle jet by itself.

The BNG-04 and -05 entries may have optional milled passage/s BNG-20 and/or BNG-21; this allows instantaneous total pressurization from either end of the needle jet and/or simultaneously.

The unique arrangement of the BNG-04/05 passages with the BNG-20/21 milled passages allows the entire BNG-31/25 needle jet assembly to be pressurized from either end and/or from both of the BNG-04/05 passages simultaneously. This allows pressurizing mixtures of air, air/fuel, vapor and/or combinations therein; to enter simultaneously and/or in a predetermined sequence.

See FIG. 1—note this isometric drawing is of the NEW STIC-BNG needle jet with the Optional Booster (702/703, etc.) installed. With FIG. 1—See detail; FIG. 4; FIG. 7; and FIG. 8.

Figure 5:
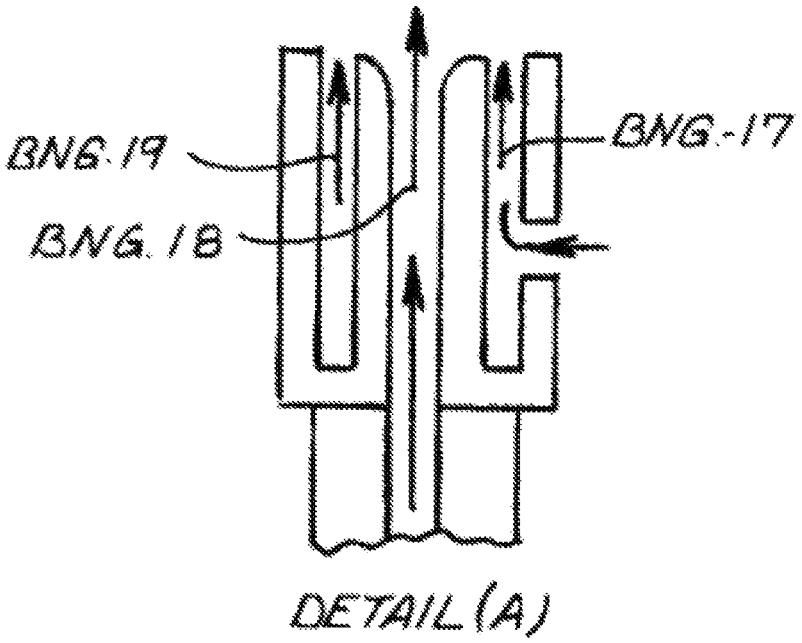
PRIOR ART FIG. 5
FIG. 5 is a fragmentary simplified schematic side view of a prior art needle jet, showing flow represented by arrows.

The "first" modification is quite simple; it consists of first sealing the BNG-17 peripheral area BNG-19 with solder and/or other means (see FIG. 5) that surrounds the BNG-06 (needle passage) exit that enters the main air stream. This is accomplished by filling the BNG-19 cavity (see FIG. 5) with a metal insert and/or with solder/epoxy, etc.; this step allows the drilling of passage BNG-05; preferably at a vectored angle allowing the frontal air BNG-11 to pass into BNG-05 and then into the BNG-06 center flow. The new manufactured STIC-BNG needle jet; peripheral area BNG-19 will be eliminated as seen in FIG. 4; illustration BNG-25.

The "second" modification will work in conjunction with the "first" modification; wherein passage BNG-20/21 may be milled from the BNG-04/05 surface to cause the BNG-11 frontal air to instantaneously enter into air cavity BNG-09. This allows the BNG-11 frontal air to then enter via BNG-20/21 into one or more vector passages BNG-01; -02; -03 etc.

The "Third" modification; may be made alone and/or in combination with mod one and/or two. The third modification consists of two phases.

The first phase consists of drilling passage BNG-04/05 (see illustration BNG-25) wherein it enters into the BNG-06 flow area (preferably at a vectored angle).

The second phase of this modification consists of milling passageway BNG-20/21 emanating from the BNG-04/05 opening/s and allowing passage into cavity BNG-09.

This allows BNG-20/21 to feed into the BNG-09 area wherein this allows the pressurizing vaporizing emulsification holes of one or more vector passages BNG-01; -02; and -03, etc., to instantaneously communicate with the BNG-06 flow direction. As previously mentioned the engagement of the auxiliary circuits; BNG-04 and BNG-05, may be activated simultaneously; and/or in a predetermined timed sequence; their activation may be made by electrical/mechanical; hydraulic; air or other means.

Specifically note; that the BNG-04 and BNG-05 passages and their related passages BNG-20; -21;—when applicable; may receive their pressure from a BNG-11 air passage or other frontal sources as well as receiving vapor, air/fuel; air, fuel; and/or fuel and pressure and/or combinations therein from other designated sources.

Figure 12:
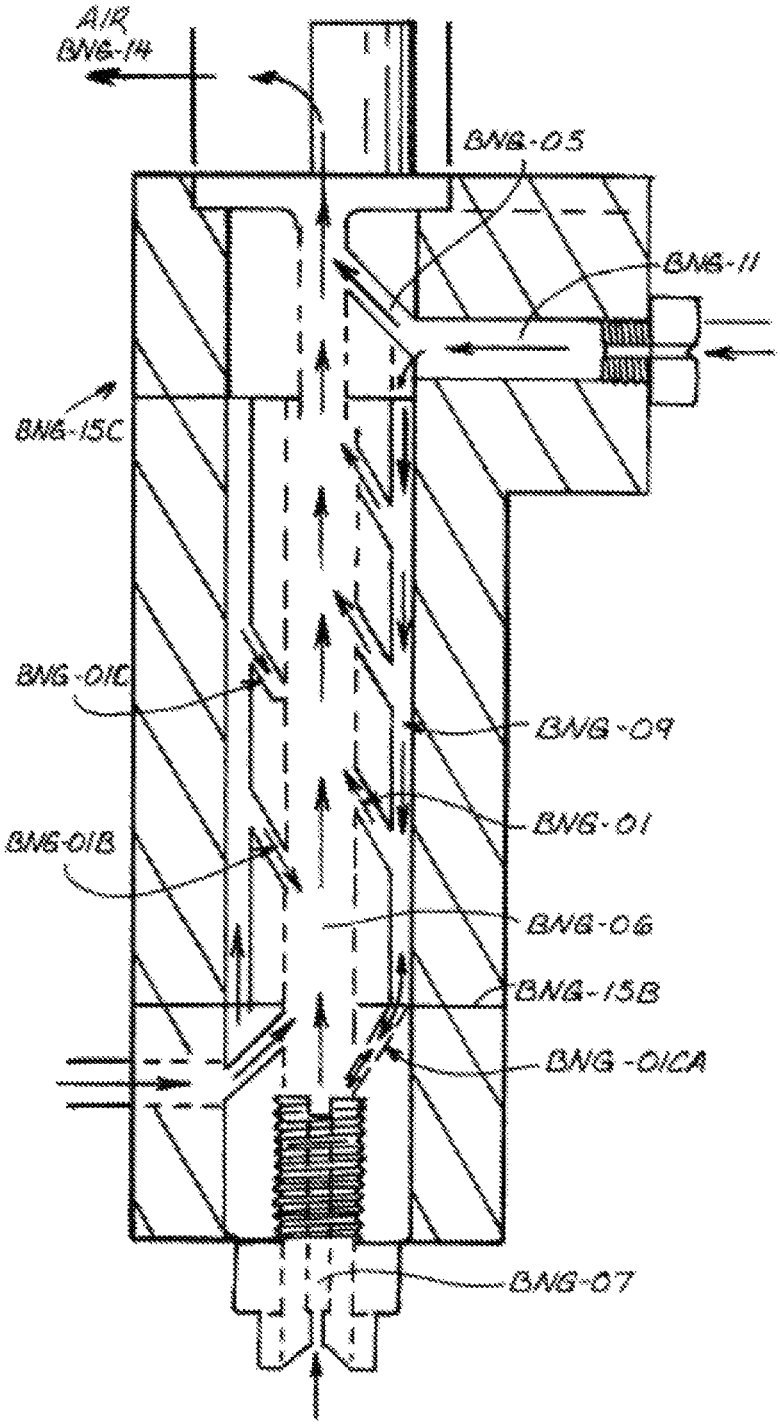
FIG. 12 is a schematic side view of a needle jet according to the invention, showing flow represented by arrows.

See FIG. 12; wherein the "Fourth" modification consists of the addition of an auxiliary booster BNG-10 (aka 702/703). This may or may not require the removal or modification of the hooded area BNG-28. Further this modification may or may not require a needle to restrict the needle jet exit opening. Further this modification may be enhanced by the addition of the pressurized vapor being introduced by the other means.

The NEW STING/STBNG

NEW STIC BNG concept allows Progressive intense vaporization within the BNG device; whereas conventional carburetion needle jets do not.

NEW STIC BNG concept allows Progressive density reduction by violent vaporization and violent emulsification within the BNG device whereas conventional carburetion needle jets do not.

NEW STIC BNG concept allows Progressive acceleration of the designed circuit air/fuel/vapor mass into its targeted outlet; whereas conventional carburetion needle jets do not.

NEW STIC BNG concept allows Progressive high vaporization independent of engine vacuum; whereas the conventional carburetion needle jets do not.

Mixture Vaporizing; Density Reduction; and Acceleration

Careful review of drawings FIGS. 1, 4, and 7-12A, reveals how the BNG system causes a pronounced improvement in circuit control; vaporizing, density reduction, acceleration; and the multiplication and escalation of these desirable features. It is important to note the detailed function of each circuit and their interrelationship. Note: See FIG. 12A; and details wherein they represent the new and modified needle jet designated as BNG-15.

Figure 12A:
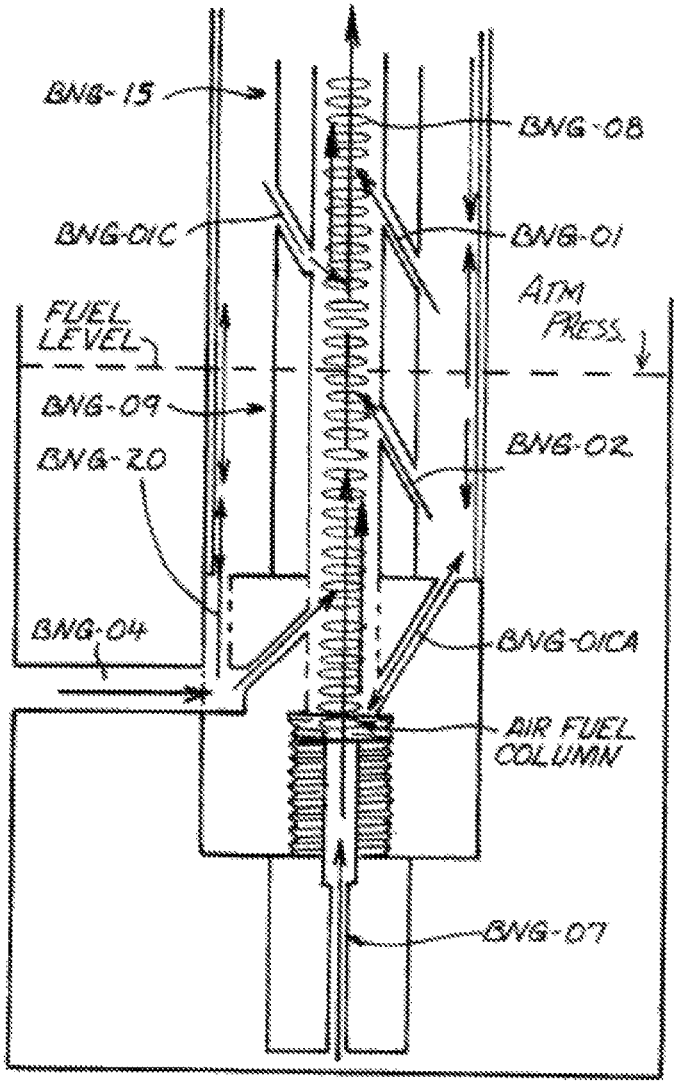
FIG. 12A is a fragmentary schematic side view of a needle jet according to the invention, showing flow represented by arrows.
Figure 13:
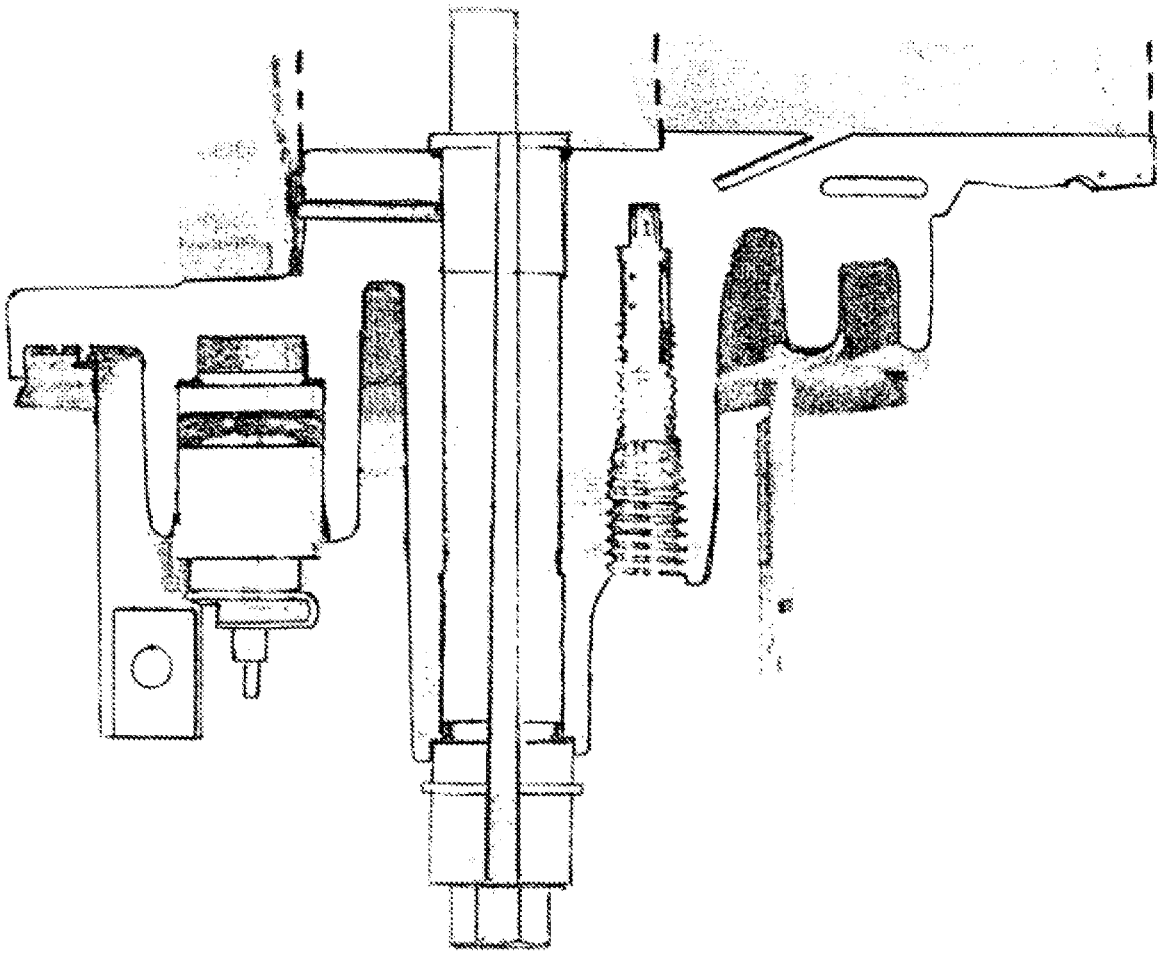
FIG. 13 is a sectional view through a representative slide type carburetor, showing a side of a needle jet of the invention installed.
Figure 14:
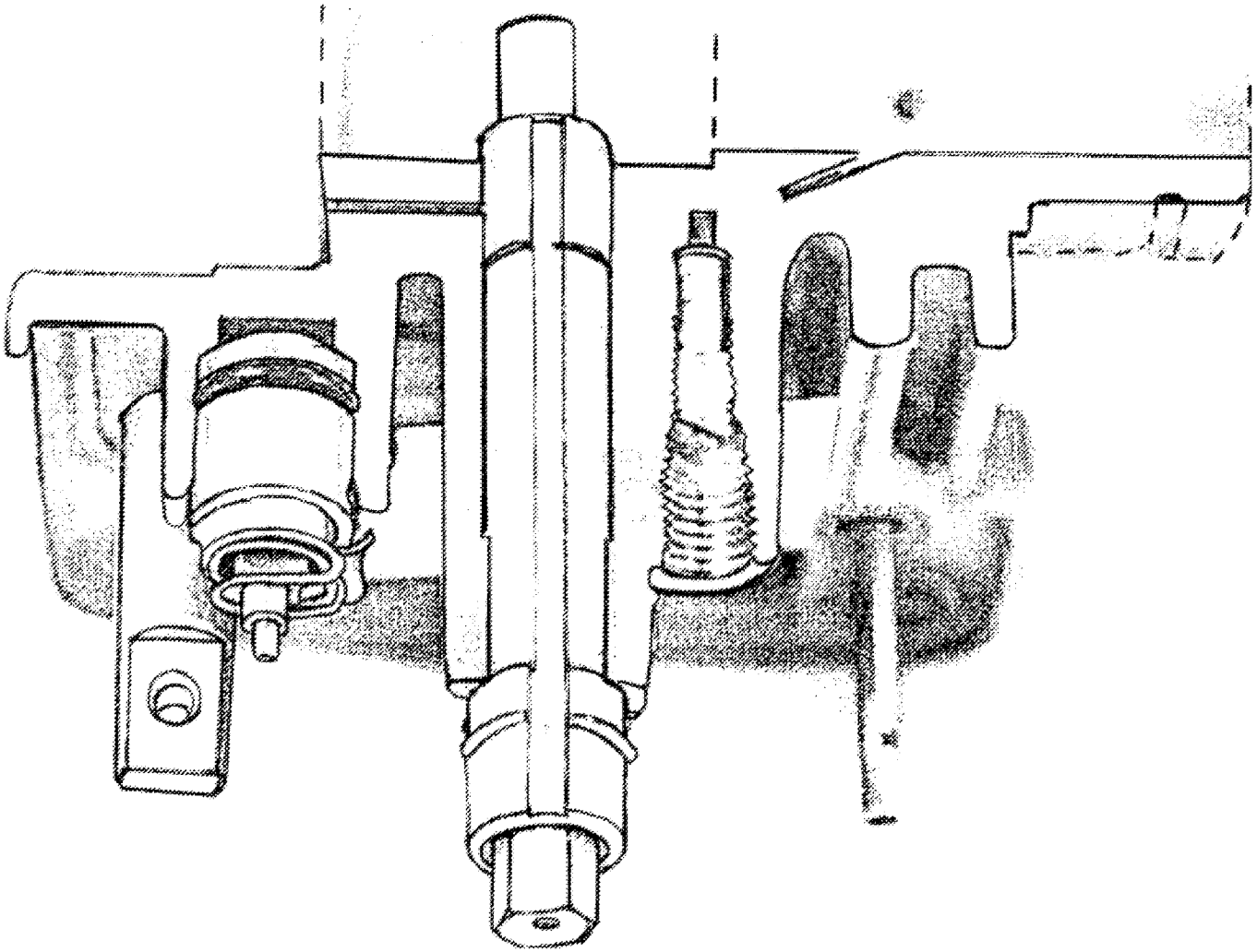
FIG. 14 is another sectional view through the representative slide type carburetor, in perspective showing aspects of the needle jet of the invention installed.
Figure 15:
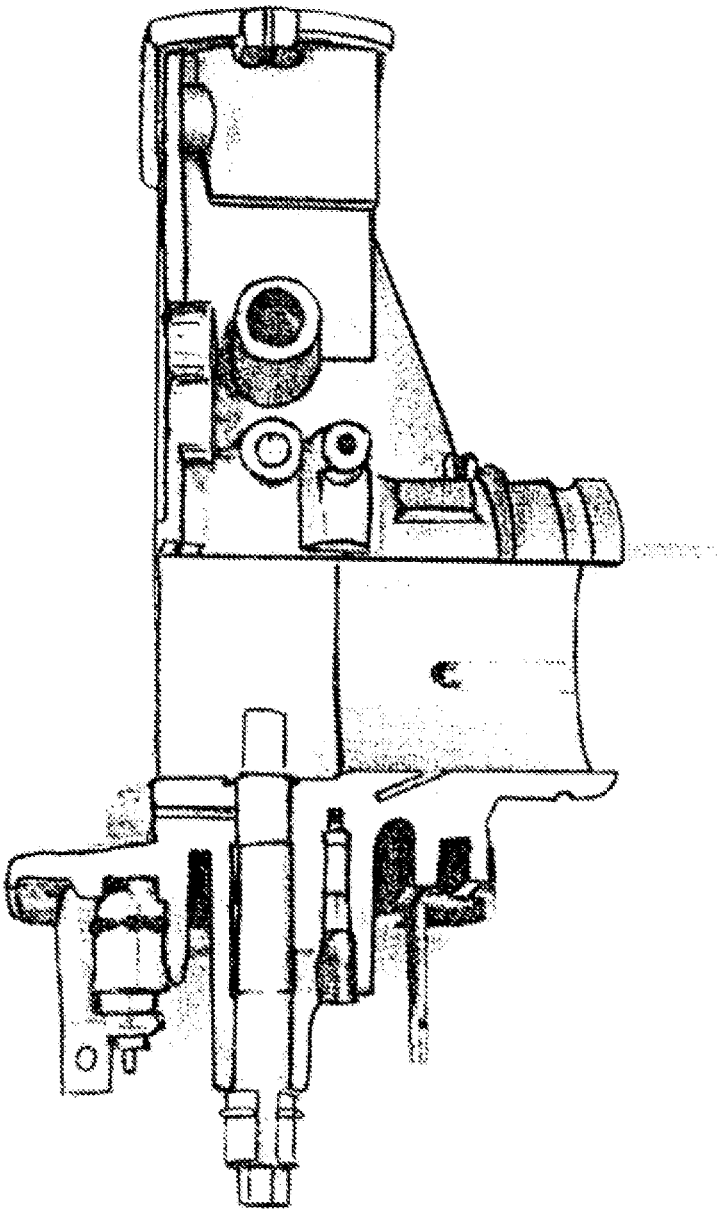
FIG. 15 is a reduced sectional view through the representative slide type carburetor, in perspective showing aspects of the carburetor.
Figure 16:
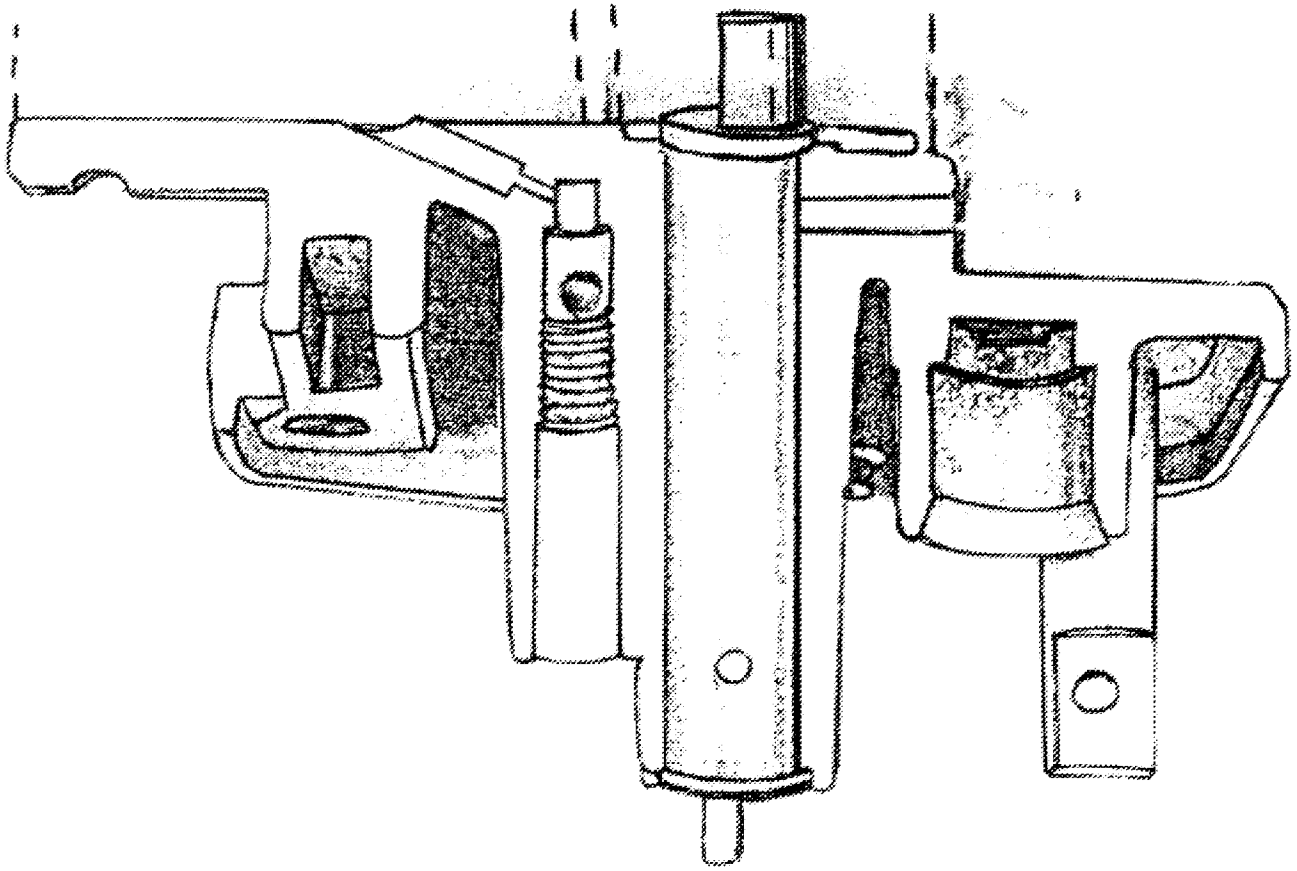
FIG. 16 is an enlarged sectional view through the representative slide type carburetor with the needle jet of the invention and other components removed.
Figure 17:
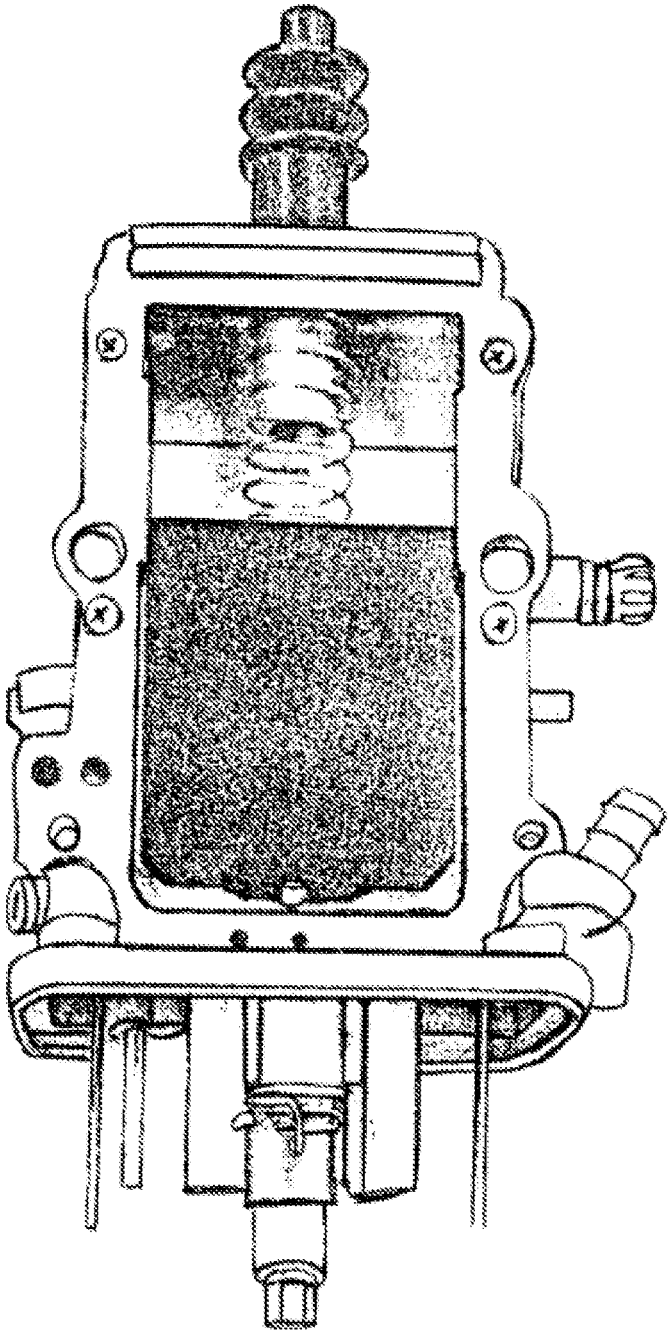
FIG. 17 is a front view of the representative slide type carburetor, showing a face plate removed to expose the slide.
Figure 18:
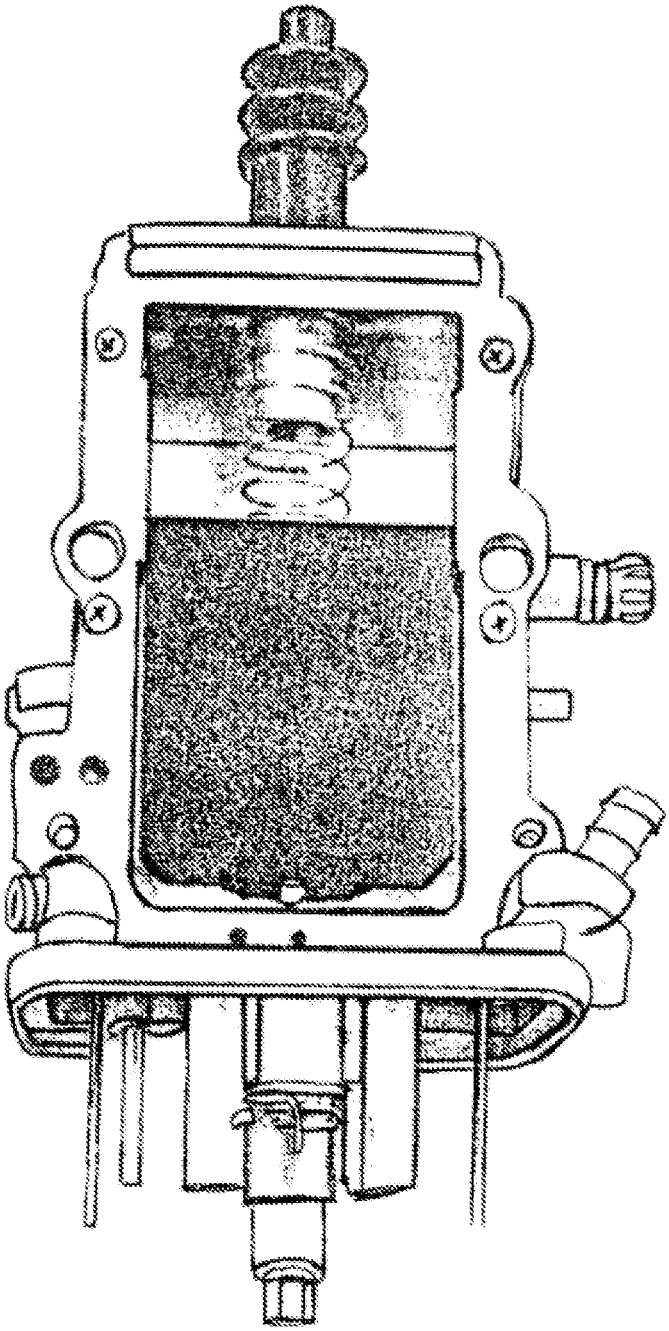
FIG. 18 is an end view of the representative slide type carburetor showing aspects of the invention.
Figure 19:
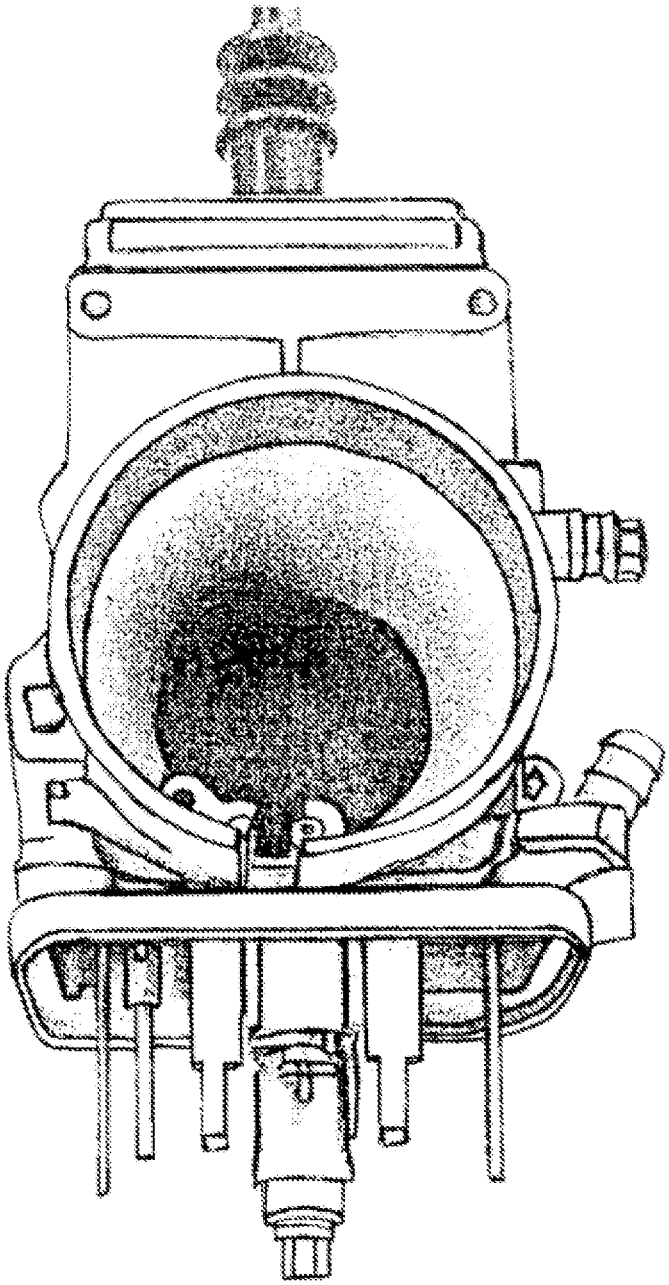
FIG. 19 is an enlarged end view of the representative slide type carburetor showing aspects of the invention in the carburetor bore.
Figure 20:
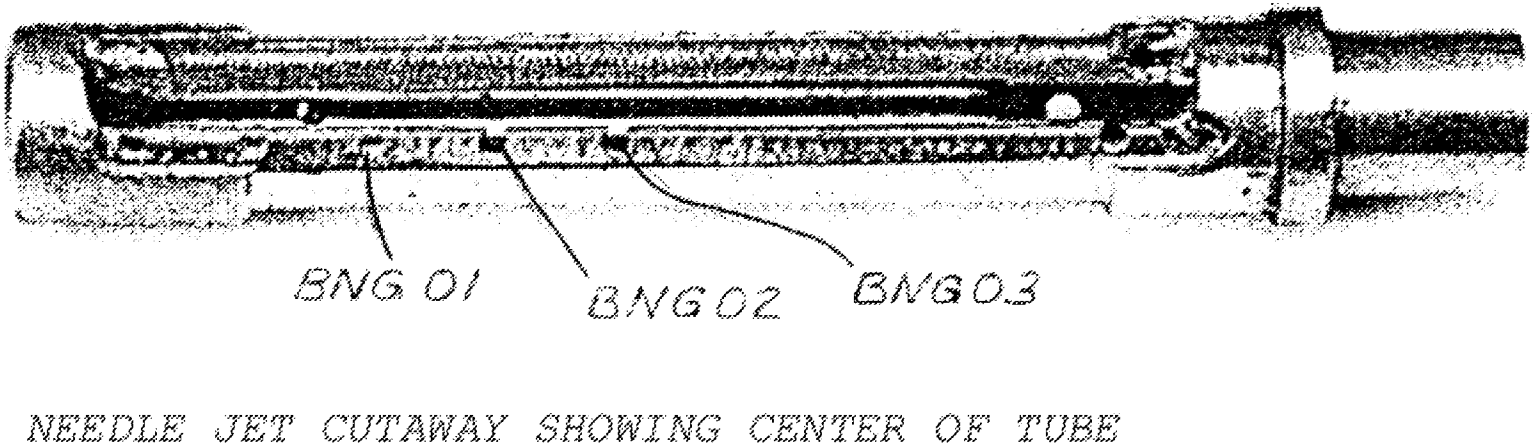
FIG. 20 is a cut away side view of a needle jet of the invention, to show internal aspects of the invention.
Figure 21:
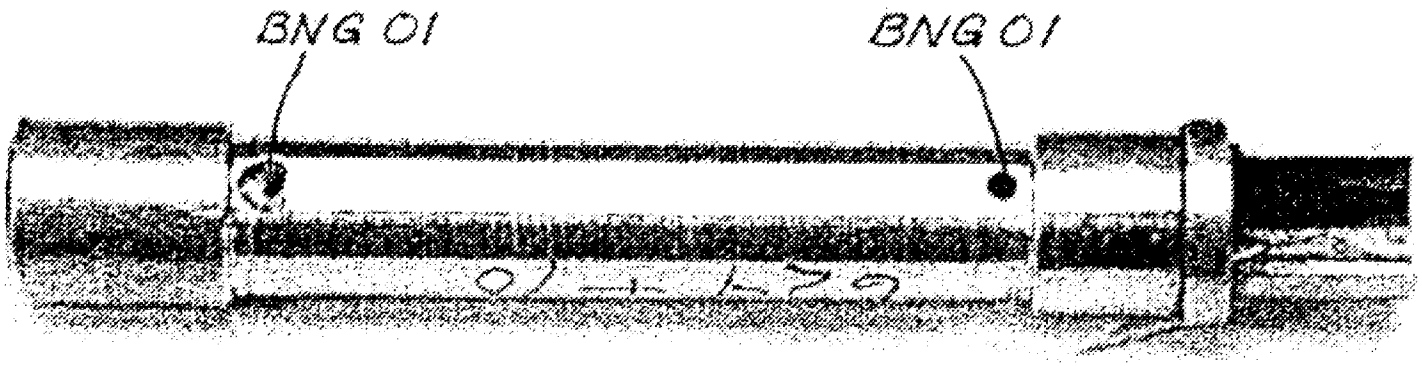
FIG. 21 is another side view of a needle jet of the invention, showing additional aspects of the invention.
Figure 22:
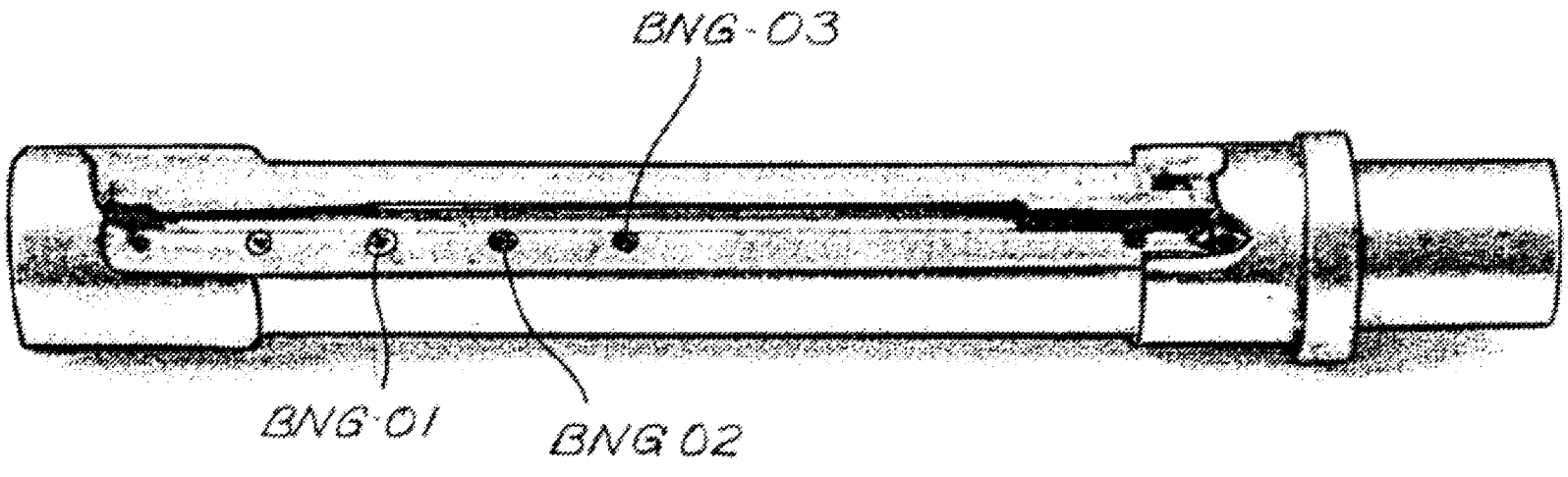
FIG. 22 is another cut away side view of a needle jet of the invention, to show internal aspects of the invention.
Figure 23:
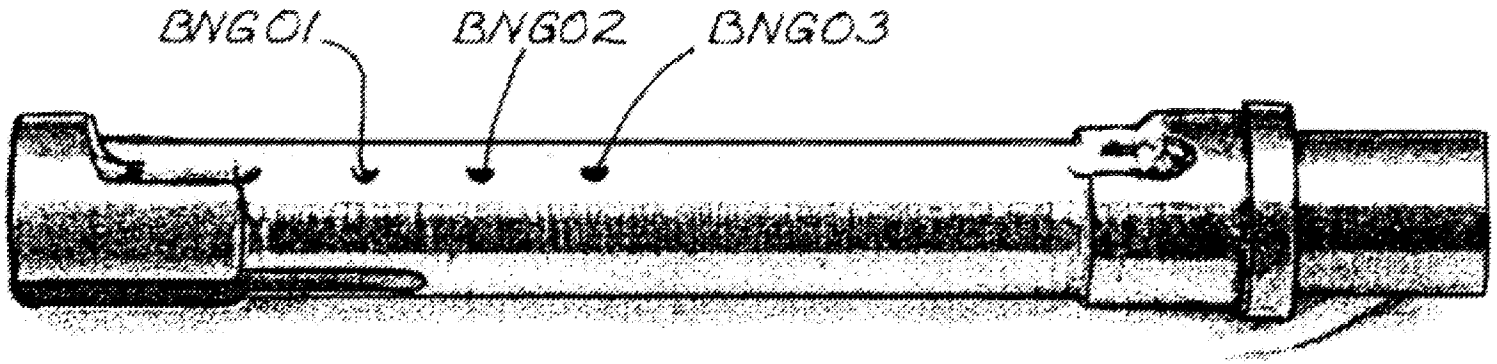
FIG. 23 is another cut away side view of a needle jet of the invention, to show internal aspects of the invention.
Figure 25:
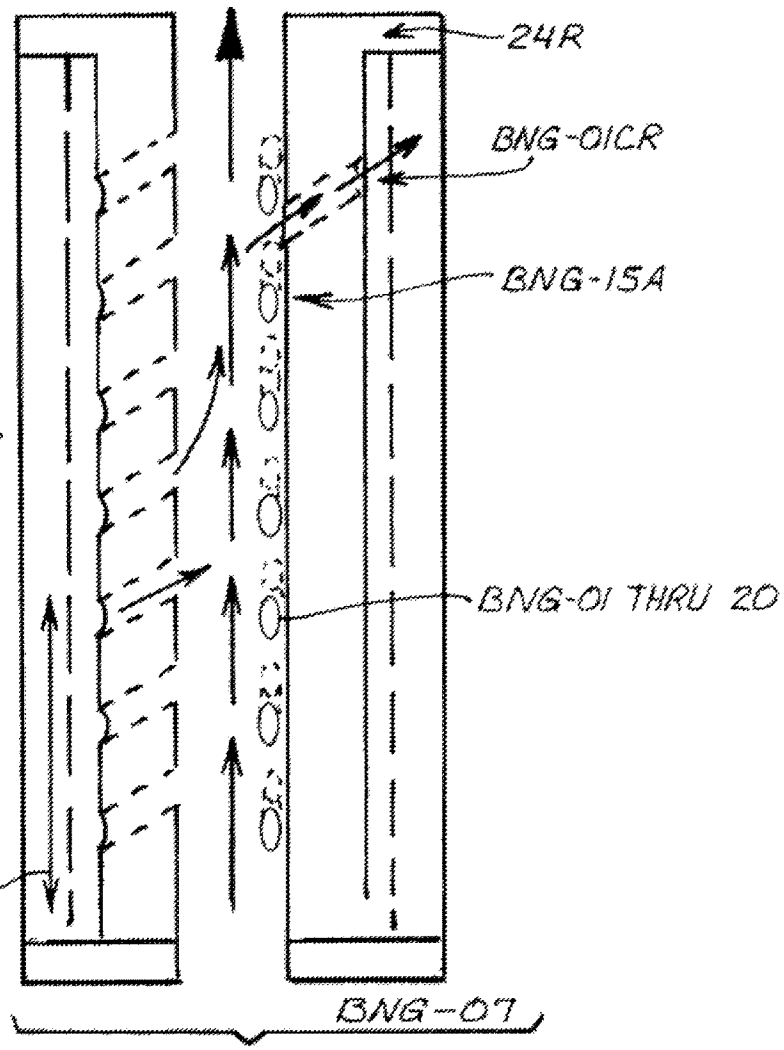
FIG. 25 is a simplified schematic side view of a needle jet having off-center vector passages, communicating with the center passage that receives the needle.
Figure 24:
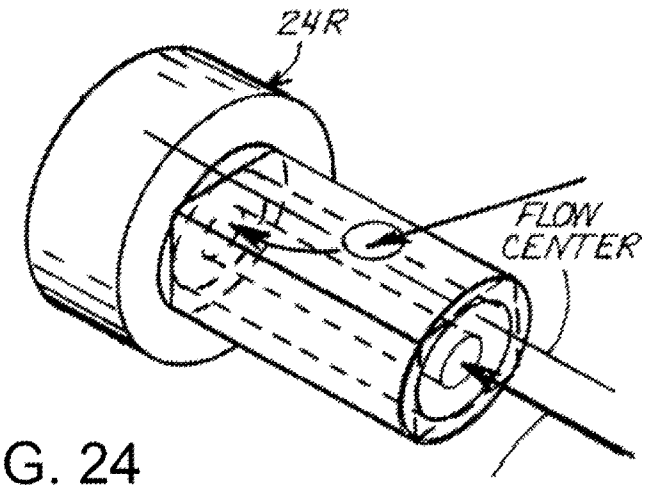
FIG. 24 is simplified schematic perspective view of the upper end of a needle jet of the invention, showing a vectored passage on a flat surface of the needle jet.
Figure 26:
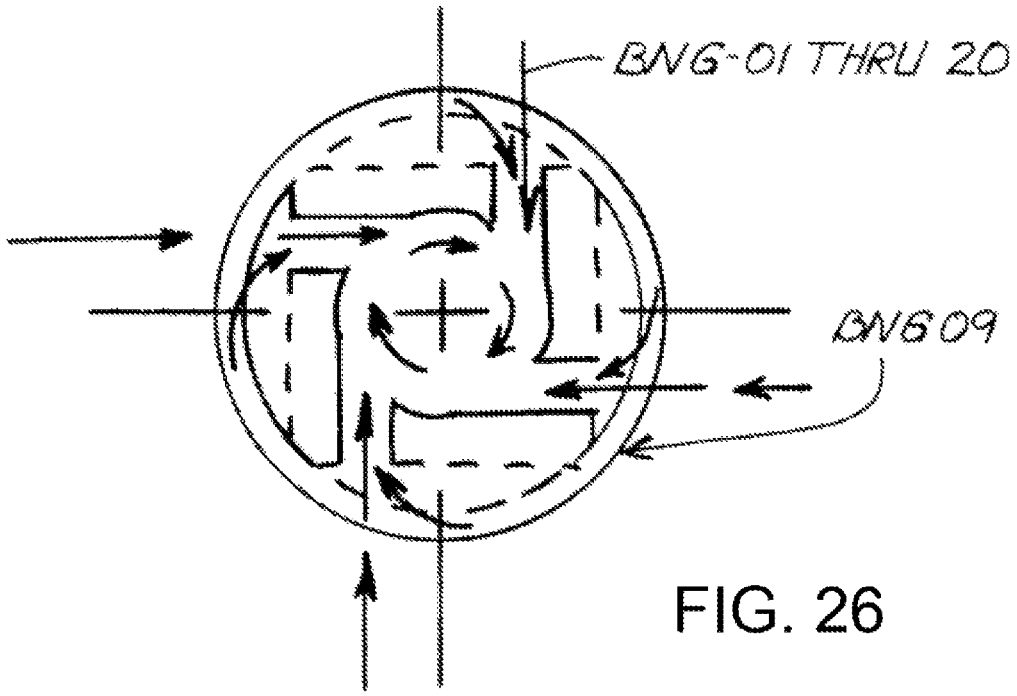
FIG. 26 is a simplified schematic end view of the needle jet of FIG. 25, showing vector passages tangent to the center passage that receives the needle, rotational flow within the center passage being depicted by arrows.
Figure 27:
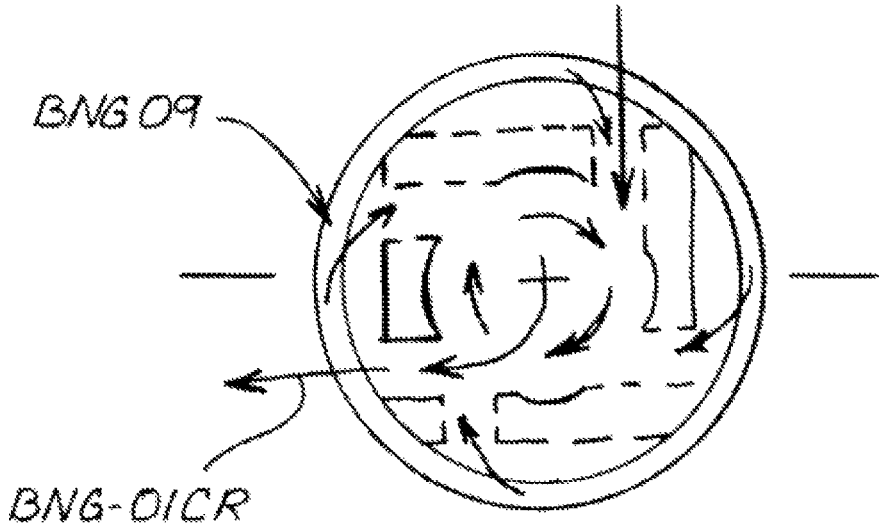
FIG. 27 is another simplified schematic end view of the needle jet of FIG. 25, showing tangential flow into the central passage and rotational flow within the central passage.

Detail from FIG. 12A

See drawing FIG. 12A. This drawing represents the flow pattern and provides a description of the related sub-details. These drawings are not to scale; angles and sizes have been exaggerated to emphasize drawing features.

Fuel into the needle jet structure BNG-15 originates from a controlled orifice (in this case main jet) BNG-07).

Fuel from the BNG-07 metering jet then flows into the interior passage BNG-06 of the BNG-15 needle jet; wherein those contents (FIG. 12A) eventually exit into a targeted passage (in this case, into the BNG-14 main air stream).

During the idle phase of the BNG fuel system; wherein the primary throttle slide/plate that controls the primary air flow is closed; flow consisting of fuel; air/fuel, vapor/ pressure and combination therein; are then permitted to flow into passage BNG-09 that surrounds the BNG-06 central main flow core.

Flow into the perimeter area BNG-09 is allowed through vector passages sub-detail letters and numbers BNG-01, 01A, 02, 03, 04, 05, 20, 21, etc., note that these circuits allow continuous communication between passages BNG-06, BNG-09 and outside forces. During the idle phase and partial throttle; these communicating circuits allow the loading, discharge, and reloading of areas BNG-06, BNG-09, etc., and others. These circuits represent several acceleration/discharge circuits that will partially and/or completely discharge their contents during partial and full maximum acceleration. This feature allows the flow control of supplementary or auxiliary circuits with fuel, air/fuel, vapor/pressure and mixture combinations therein to insure that they are instantly recharged for successive vaporization and acceleration.

The vector passages, under predetermined conditions, allow these circuits to provide disruptive controlled opposing forces intended to disrupt (mix) the main flows with single forces as well as various forces and/or mixture combinations.

Careful review of vector passages BNG-01, 02, etc., wherein the contents of area BNG-09 are caused to discharge into area BNG-06 wherein these forces and/or mixtures are caused to intersect and flow into the BNG-06 flow direction; it will become evident to those familiar with the art; that this will cause successive pressure drops at each intersecting point (consisting of one or more intersecting points). This type of vaporization is caused by the shearing action (pressure removal) created by the flow of the incoming circuit mixing with the flow of intersected circuit. This concept may be implemented by the creation of one or more circuits that are designed to intersect and cross a targeted flow.

See drawing 12A; BNG-01C. This designed feature; an angled protrusion in the passage exit; allows a designed opposing force to enter the BNG-06 flow; and at the same time this obstruction prevents the BNG-06 flow directional force from entering the incoming disruptive force. This feature which may be located in a number of positions (one or more); uniquely allows a reverse flow only when the main circuit flow is not active; thus this concept allows the recharging of acceleration discharge circuits at certain reduced throttle positions. However when the throttle is opened and the BNG-06 direction achieves a certain force (velocity); the (DA) protrusion in the BNG-01C vector passage prevents the BNG-06 force from entering the designed obstruction; thus allowing the disruptive force to enter the BNG-06 flow.

Figure 6:
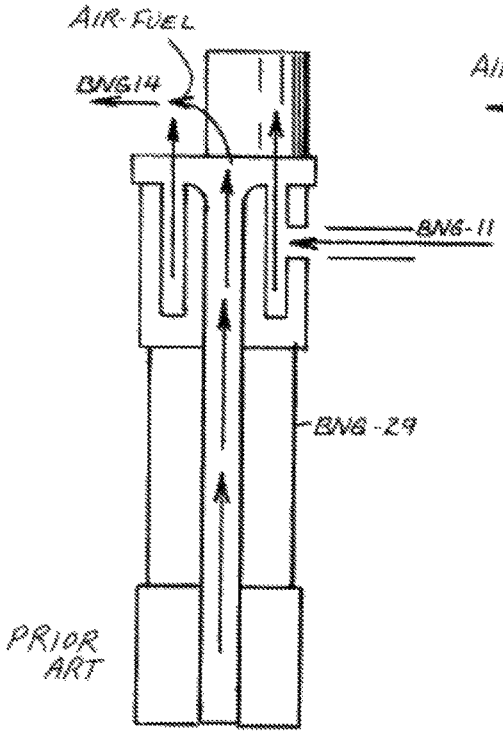
FIG. 6 is a simplified schematic side view of a prior art needle jet, showing flow represented by arrows.

Detail from FIG. 12A: Detail BNG-01CA; FIG. 6

See drawing FIG. 12A; BNG-01CA and FIG. 12. The BNG-01CA allows the fuel level in the interior BNG-06 and BNG-09 and its communicating sources to assume the same level as the main holding chamber (in this case, the float bowl). This feature creates one or more passages leading to storage areas; that act as acceleration discharge chambers; providing progressive power circuits based on air speed and pressure drops.

Details of the Weber, Dellorto, Mikuni (Weber Type) Needle Jet

Figure 2:
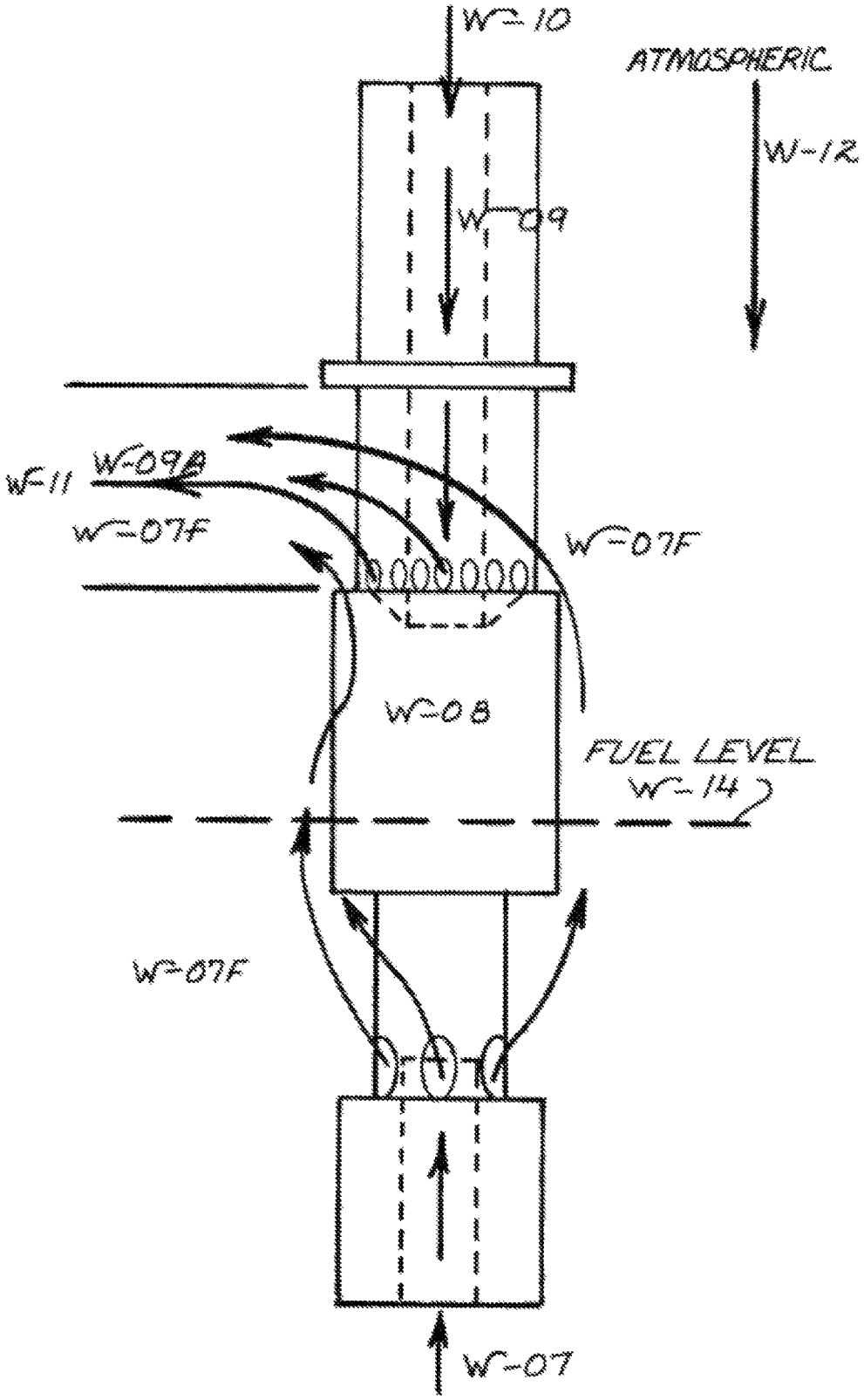
Prior Art FIG. 2
FIG. 2 is a simplified schematic diagram showing carburetor circuitry representative of several prior art carburetors.

FIG. 2; numbers W-07 through W-14. The Weber, Dellorto, Mikuni (Weber-Type) needle jet is dissimilar to the BNG Needle Jet and employs a completely different concept in emulsification and lacks any vaporization within the needle jet structure. The Weber, Dellorto, Mikuni (Weber-Type) needle jet emulsification source consists of an air-jet orifice (W-10; W-09) that is encapsulated within a cover that only allows atmospheric air pressure W-12 to communicate with the needle jet center passage W-09 wherein it then enters bubbler passages. Within the Weber, Dellorto, Mikuni (Weber-Type) carburetor; the main jet (W-07) allows fuel to first enter the needle jet from the bottom; wherein the fuel W-07F then enters an outer peripheral area that surrounds the entire needle jet structure W-08 center section. This main jet peripheral area fuel W-07F then passes up on the outside of the center of the needle jet W-08 to the booster connected circuit/s; near the top and just prior to the fuel entering into the booster passage/s W-11. This fuel; W-07F passes by passages (bubblers) that are directly communicating with the main atmospheric air well W-09 emanating from air correction jet/s W-10 that receives its air pressure from area W-12.

The Weber, Dellorto, Mikuni (Weber-Type) needle jet distinctly does not communicate with the idle/intermediate circuit(s) and it does not communicate with pressurized, vaporizing power circuits. The Weber, Dellorto, Mikuni (Weber-Type) carburetor needle jet is a stand-alone tuning item and serves no other function other than to provide a path (W-07F) for the fuel to pass by a generic bubbler type system (W-09) to allow low atmospheric pressure W-12 to bubble into the mixture before exiting into passage W-11 and then into the booster outlet/s.

See the following references to drawing FIG. 2: and its related numbers that are representative of the needle jets that are part of the Weber, Dellorto, and Mikuni (Weber-Type) carburetor/s.

Fuel enters from the bottom of opening W-07 and exits outside W-07F of the W-08 center section (into the peripheral cavity).

Atmospheric pressure W-12 enters from the upper end W-10 and ends at the bottom of the center W-09 air well of the needle jet.

The atmospheric air W-12 enters W-10 air correction and then into the W-09 air well wherein the atmospheric air then bubbles into the fuel W-07F; wherein the air/fuel mixture then enters passage W-11 prior to exiting into the booster/s prior to their entry into the intake runner/s aka manifold and engine.

Weber, Dellorto, the Similar Mikuni Summation

In summation of the Weber, Dellorto, and the similar Mikuni type carburetors; of which are considered by the industry to be bench-mark sophisticated carburetors; representing the embodiment of perfection; there is no prior art within their systems that is commensurate (equal) to the BNG concepts of the invention. In conventional carburetion concepts; it is differential pressure that is normally confined to atmospheric pressure and the drop in pressure at the BNG-06 exit into the air flow that is lifting the liquid out of the fuel bowl or circuit cavity; this same basic concept is employed by the entire industry including the Weber, Dellorto, and the similar Mikuni type carburetors.

The heavy mass of raw fuel must be lifted from its holding chamber to the BNG-06 outlet; thus it makes sense that BNG concept of emulsified; pressurized/vaporized fuel with progressive density reduction and velocity increase would cause the mixture to be lighter as each progressive act of vaporization that progressively accelerates the less dense air/fuel mixture. The addition of the auxiliary secondary BNG energizing source to the Weber, Dellorto, and Solex carburetors; makes a substantial increase in the vaporizing and torque quality of these benchmark carburetors; improving their horsepower and torque as well as reducing their emissions.

Holley; Other Carburetors, Fuel Injection; W/BNG Modifications

The BNG concept may be retrofitted into all existing carburetion and fuel injection systems. The BNG concept may be engineered into new carburetion and fuel injection structure; causing extreme vaporization and emulsification. In those systems of fuel injection that merely inject raw fuel into their targeted area; the addition of BNG vaporization and emulsification concepts will cause a significant increase in torque, horsepower, and acceleration. The BNG concept high level of efficiency causes a significant reduction in emission.

BNG Concept Causes a Violent Discharge of the Control Circuit(s)

The NEW STIC BNG concept causes an explosive discharge of the designed BNG circuit/s and their contents; to violently move into their targeted destination; of which could include other circuits as well as the main air flow. In order to move a product and/or mixture (in this case various mixtures and combinations therein into a targeted circuit by differential pressure; one must consider the density and viscosity of the mass as well as the volume; the amount of mass to be moved. A critical consideration in causing circuit discharge; is the comparative surface area of the communicating circuits. The diameter of the orifice (the tube) that the mix/mass is accelerating from; when trying to move it (in this case; fuel, air/fuel, vapor/pressure, and combinations therein); to its targeted destination; determines how fast the discharge is.

It should be noted that pressure exertion on the surface of a fuel well/circuit (in this case pounds per square inch, (psi)) is determined by the air/fuel surface area. Another factor in considering air/fuel (and its related components); movement, is the pressure drop (in this case the carburetor fuel circuit outlet) that it is exposed to a directional flow causing a pressure drop at the outlet of the communicating discharge circuit; it must be less than the pressure acting on the (cavity/passage) float bowl (in this case fuel bowl). The issue of transit time of pressure (in this case atmospheric pressure) through a liquid/verses air; is a fact that is well known by those familiar with the art of fuel system design. See Woody, U.S. Pat. No. 5,133,905; page: 9: "Although the transit time of a pressure wave in air and liquid is different . . . ."

In summation, the NEW STIC BNG needle jet concept makes vaporization, emulsification and circuit control movement more effective and predictable. The NEW STIC BNG needle jet design overcomes the issues of poor vaporization; poor circuit activation, and poor mixture control. The STIC-BNG needle jet may stand alone in various stages of modification as a retro-fit into all existing carburetion and injection and/or it can optionally be made into an ultimate structure; designed into a metering block; and/or incorporated into a new carburetor and/or fuel injection structure.

Figure 10:
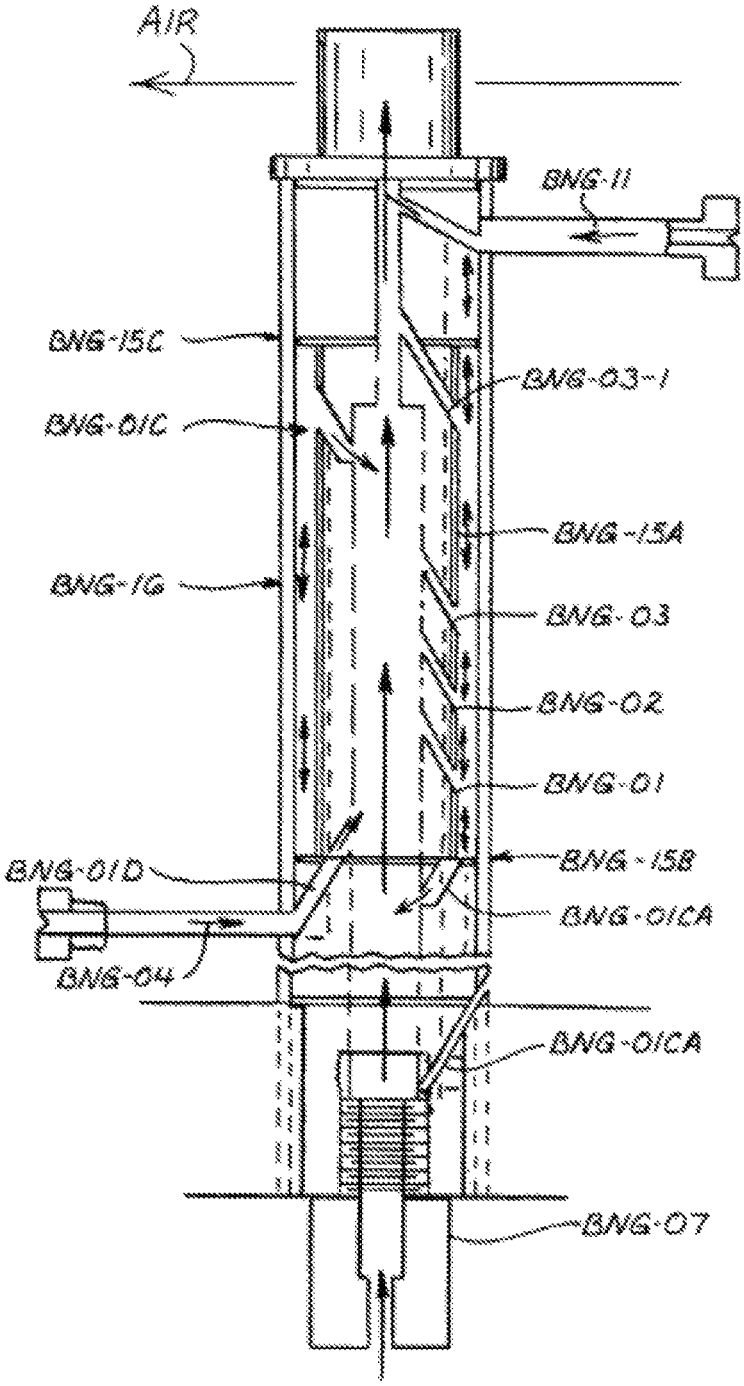
FIG. 10 is a simplified schematic side view of a needle jet according to the invention, showing flow represented by arrows.
Figure 11:
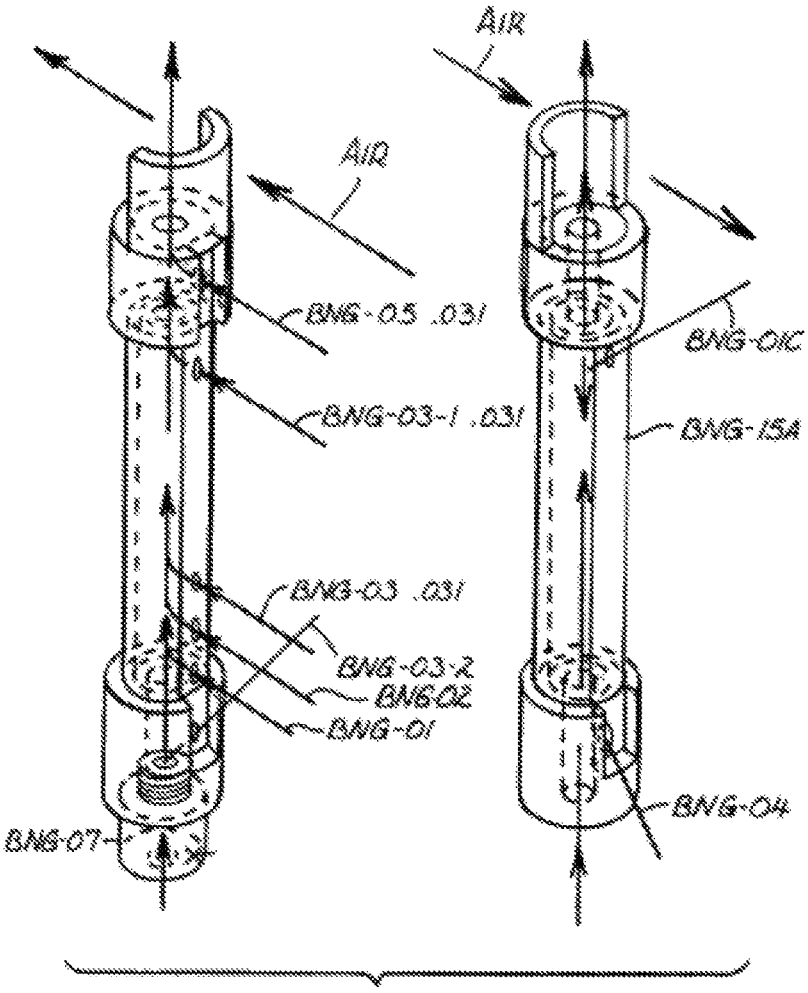
FIG. 11 is two simplified schematic perspective views of a needle jet according to the invention, showing flow represented by arrows.

Note that FIG. 10 is an engineering manufacturing drawing; wherein the dimensional drawing represents the Mikuni 389 needle jet; manufactured to the new proprietary BNG specs.

FIGS. 13-23 show a commercially available flat slide carburetor incorporating a needle jet of the invention, including vector passages BNG-01 through BNG-03 as described above.

Note also the option of utilizing combinations of plus (+) and minus (–) vectors. The BNG-01C allows pressurization and obstruction to flow in one scenario and this very same circuit when exposed to an increased targeted main flow; will allow portions of that mixture to egress (exit) to the BNG-09 peripheral area to again be vaporized in a continuous process. Further, the portion of mixture that was caused to exit into the BNG-01C passage has a degree of pressurization that will contribute to the overall targeted mixture speed when it reenters the BNG-06 passage; thus a continuous multiplying factor is created.

It should also be noted that the vector passages, e.g., BNG-01 through BNG-20, can be advantageously tangent and/or off-set to a centerline of the needle jet main flow passage. In particular, it has been found that this can generate a rotational component to the air fuel flow therethrough. This is illustrated in FIGS. 24 through 27, showing vectored passages BNG-01 through BNG-20 extending off center from the peripheral passage about the needle jet and generally tangential to the center needle jet passage, the rotational flow of the air fuel mixture within that passage being denoted by arrows in FIGS. 26 and 27. It should be noted that the rotation flow here is depicted as clockwise, but by orienting the tangential vector passages to be tangential in the opposite manner, counterclockwise rotational flow can be achieved.

Thus, there has been shown and described a novel fuel air delivery circuit, system, and method for the intake of an internal combustion engine, which overcomes many of the problems set forth above. It will be apparent, however, to those familiar in the art, that many changes, variations, modifications, and other uses and applications for the subject device are possible. All such changes, variations, modifications, and other uses and applications that do not depart from the spirit and scope of the invention are deemed to be covered by the invention which is limited only by the claims which follow.

What is claimed is:

1. A jet for a fuel air delivery system, comprising:

a body having an elongate fuel delivery passage therethrough, the body being configured and sized to be cooperatively received in a passage of the fuel air delivery system extending from a cavity for holding a quantity of fuel, to a main intake passage for flow of an air-fuel mixture, the body having an external surface which when the body is located in the passage of the fuel air delivery system extending from the cavity for holding a quantity of fuel to the main intake passage, will bound and define a cavity extending at least partially about a predetermined portion of a length of the body;

an inlet opening at a first end of the body connecting to the fuel delivery passage and configured and disposed to connect with the cavity for holding the quantity of fuel, and an outlet opening connecting to the fuel delivery passage at a second end of the body and configured to connect with the main intake passage;

the body having a plurality of vector passages extending therethrough at spaced locations along the predetermined portion of the length thereof, from the exterior surface to the fuel delivery passage in intersecting relation thereto, and at least one vector passage extending through the body at a location between the predetermined portion of the length thereof and the outlet opening, connected to the fuel delivery passage, wherein at least some of the vector passages are oriented at an acute angle to the longitudinal direction of the jet so as to extend at an acute angle toward the outlet opening.

2. The jet of claim 1, wherein at least some of the vector passages are off-set from a center of the body.

3. The jet of claim 1, wherein at least some of the vector passages are tangential to the fuel delivery passage.

4. The jet of claim 1, comprising at least 9 of the vector passages.

5. The jet of claim 1, incorporated into an assembly including a booster positioned and configured to be located in the main intake passage.

6. The jet of claim 1, wherein at least one of the vector passages at the location between the predetermined portion of the length of the body and the outlet opening, is disposed to connect directly to an air source separate from the main intake passage.

7. A jet for a fuel air delivery system, comprising:

a body having an elongate fuel delivery passage therethrough, the body being configured and sized to be cooperatively received in a passage of the fuel air delivery system extending from a cavity for holding a quantity of fuel, to a main intake passage for flow of an air-fuel mixture, the body having an external surface which when the body is located in the passage of the fuel air delivery system extending from the cavity for holding a quantity of fuel to the main intake passage, will bound and define a cavity extending at least partially about a predetermined portion of a length of the body;

an inlet opening at a first end of the body connecting to the fuel delivery passage and configured and disposed to connect with the cavity for holding the quantity of fuel, and an outlet opening connecting to the fuel delivery passage at a second end of the body and configured to connect with the main intake passage;

the body having a plurality of vector passages extending therethrough at spaced locations along the predetermined portion of the length thereof, from the exterior surface to the fuel delivery passage in intersecting relation thereto, and at least one vector passage extending through the body at a location between the predetermined portion of the length thereof and the outlet opening, wherein at least some of the vector passages are off-set from a center of the body.

8. The jet of claim 7, comprising a carburetor, and wherein the body is received in a passage of the carburetor extending from the cavity for holding a quantity of fuel, such that the at least one vector passage extending through the body connects directly to an air flow passage through the carburetor.

9. The jet of claim 8, wherein the vector passage extending through the body between the predetermined portion of the length thereof and the outlet opening of the body is oriented at a small acute angle to the fuel delivery passage.

10. The jet of claim 7, wherein interfaces of the vector passages with the fuel delivery passage are relatively small compared to a sectional extent of the fuel delivery passage.

11. A jet for an air fuel mixing device, comprising:

a body having an elongate fuel passage of a predetermined sectional extent therethrough configured for delivering a metered flow of fuel to an enclosed intake path of the air fuel mixing device, the body being configured and sized to be cooperatively received in a passage of the air fuel mixing device extending from a cavity for holding a quantity of fuel, and the enclosed intake path, the body having an external surface which when the body is located in the passage of the air fuel mixing device, with a surface bounding the passage of the air fuel mixing device, will bound and define an enclosed cavity extending at least partially about the body along a portion of a length thereof;

an inlet opening at a first end of the body connecting to the fuel passage and configured and disposed to connect with the cavity for holding the quantity of fuel, and an outlet opening connecting to the fuel passage at a second end of the body and configured to connect with the enclosed intake path of the device;

the body having a plurality of vector passages extending therethrough at spaced locations along the portion of the length thereof, from the exterior surface to the fuel passage in intersecting relation thereto, and at least one vector passage extending through the body from the exterior surface to the fuel passage in intersecting relation thereto at a location along the length of the body between the portion of the length thereof and the outlet opening, disposed to connect directly to an air flow passage separately from the enclosed intake passage and connecting to an air source, wherein at least some of the vector passages are tangential to the fuel passage.

12. The jet of claim 11, wherein at least some of the vector passages are off-set from a center of the body.

13. The jet of claim 11, comprising at least 9 of the vector passages.

14. The jet of claim 11, incorporated into an assembly including a booster positioned and configured to be located in the intake path of the air fuel mixing device.

15. The jet of claim 11, wherein at least some of the vector passages are oriented at an acute angle to the longitudinal direction of the fuel passage.

16. The jet of claim 11, wherein the body has a longitudinally extending passage on the external surface connecting the at least one vector passage to the portion of the length of the body.

17. The jet of claim 16, comprising the air fuel mixing device, and wherein the air fuel mixing device includes an air flow passage connecting with the passage of the device extending from the cavity for holding a quantity of fuel, and the intake path, and the at least one vector passage of the body of the jet is positioned to connect with the air flow passage of the device.

18. The jet of claim 17, wherein the at least vector passage of the body is oriented at a small acute angle to the fuel passage.

19. The jet of claim 11, wherein interfaces of the vector passages with the fuel passage are relatively small compared to a sectional extent of the fuel passage.

* * * * *